US007519317B2

(12) United States Patent
Hosokawa et al.

(10) Patent No.: US 7,519,317 B2
(45) Date of Patent: Apr. 14, 2009

(54) DEVELOPER CONTAINER, DEVELOPER SUPPLYING DEVICE, AND IMAGE FORMING APPARATUS

(75) Inventors: Hiroshi Hosokawa, Kanagawa (JP); Kiyonori Tsuda, Kanagawa (JP); Satoshi Narumi, Kanagawa (JP); Ryuta Takeichi, Kanagawa (JP); Yuji Arai, Kanagawa (JP); Masanori Kawasumi, Kanagawa (JP); Kazuhiko Umemura, Shizuoka (JP); Hiroshi Ishii, Kanagawa (JP); Yutaka Fukuchi, Kanagawa (JP); Kazuki Suzuki, Saitama (JP); Yuusuke Noguchi, Kanagawa (JP); Kazuosa Kuma, Kanagawa (JP); Makoto Kikura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/845,590

(22) Filed: Aug. 27, 2007

(65) Prior Publication Data

US 2008/0003021 A1 Jan. 3, 2008

Related U.S. Application Data

(60) Division of application No. 10/864,672, filed on Jun. 10, 2004, now Pat. No. 7,321,744, which is a continuation of application No. PCT/JP2004/002025, filed on Feb. 20, 2004.

(30) Foreign Application Priority Data

| | | | |
|---|---|---|---|
| Feb. 28, 2003 | (JP) | ..... | 2003-052658 |
| Feb. 28, 2003 | (JP) | ..... | 2003-054478 |
| Jan. 9, 2004 | (JP) | ..... | 2004-004668 |

(51) Int. Cl.
*G03G 15/08* (2006.01)

(52) U.S. Cl. ..... 399/258; 399/262

(58) Field of Classification Search ..... 399/119, 399/120, 258, 262, 263; 222/167, 169, 325, 222/327, 414, 564, 565, DIG. 1
See application file for complete search history.

(56) References Cited

U.S. PATENT DOCUMENTS 4,878,603 A 11/1989 Ikesue et al.

(Continued)

FOREIGN PATENT DOCUMENTS

CN 1164682 A 11/1997

(Continued)

OTHER PUBLICATIONS

Patent Abstracts of Japan, JP 09-197783, Jul. 31, 1997.

(Continued)

*Primary Examiner*—Robert Beatty
(74) *Attorney, Agent, or Firm*—Oblon, Spivak, McClelland, Maier & Neustadt, P.C.

(57) ABSTRACT

A developer container has a main part accommodating a developer therein and is detachably attached to an image forming apparatus. The developer container comprises a rotation unit which is rotatable to the developer container main part and having an outlet to discharge developer from the developer container, a shutter provided on the rotation unit to open and close the outlet by rotation of the rotation unit, and an engagement unit provided on the periphery side portion of the rotation unit in order to prevent rotation of the rotation unit when attached to the image forming apparatus.

25 Claims, 21 Drawing Sheets

U.S. PATENT DOCUMENTS 5,441,177 A 8/1995 Yanagisawa
5,455,662 A 10/1995 Ichikawa et al.
5,506,665 A * 4/1996 Ishida et al. ..... 399/119
5,557,382 A 9/1996 Tatsumi et al.
5,608,501 A * 3/1997 Makino ..... 399/119
5,648,840 A 7/1997 Ikunami et al.
5,659,860 A 8/1997 Sasaki et al.
5,722,014 A 2/1998 Fike
5,722,019 A 2/1998 Nakajima
5,754,916 A 5/1998 Kitayama et al.
5,758,235 A 5/1998 Kosuge et al.
5,765,059 A 6/1998 Kosuge et al.
5,765,079 A 6/1998 Yoshiki et al.
5,768,664 A 6/1998 Kosuge et al.
5,774,773 A 6/1998 Otsuka et al.
5,794,108 A 8/1998 Yoshizawa et al.
5,828,935 A 10/1998 Tatsumi et al.
5,890,034 A * 3/1999 Nakano et al. ..... 399/106
5,890,040 A 3/1999 Matsuoka et al.
5,909,610 A 6/1999 Yoshiki et al.
5,913,097 A 6/1999 Nakano et al.
5,915,155 A 6/1999 Shoji et al.
5,966,574 A 10/1999 Ui et al.
5,970,290 A 10/1999 Yoshiki et al.
6,104,900 A 8/2000 Ishikawa et al.
6,118,951 A 9/2000 Kato et al.
6,125,243 A 9/2000 Shoji et al.
6,141,520 A 10/2000 Kosuge
6,151,472 A * 11/2000 Nakajima ..... 399/262
6,163,666 A 12/2000 Hosokawa et al.
6,185,401 B1 2/2001 Kanamori et al.
6,195,521 B1 * 2/2001 Nozawa et al. ..... 399/262
6,198,895 B1 3/2001 Tsuda et al.
6,212,343 B1 4/2001 Hosokawa et al.
6,256,469 B1 7/2001 Taniyama et al.
6,266,501 B1 7/2001 Mizuishi et al.
6,289,195 B1 9/2001 Ichikawa et al.
6,336,020 B1 1/2002 Ishikawa et al.
6,337,957 B1 1/2002 Tamaki et al.
6,363,237 B1 3/2002 Nagame et al.
6,366,755 B1 4/2002 Takashima
6,393,241 B1 5/2002 Matsumoto et al.
6,447,973 B1 9/2002 Asami et al.
6,493,529 B1 12/2002 Umemura et al.
6,501,913 B2 12/2002 Hattori et al.
6,507,720 B2 1/2003 Kabumoto et al.
6,521,386 B1 2/2003 Sakon et al.
6,522,855 B1 2/2003 Katoh et al.
6,558,862 B2 5/2003 Kojima et al.
6,560,431 B2 5/2003 Hosokawa
6,562,529 B1 5/2003 Kojima et al.
6,567,637 B2 5/2003 Yanagisawa et al.
6,591,077 B2 7/2003 Yanagisawa et al.
6,615,013 B2 9/2003 Arai et al.
6,628,908 B2 9/2003 Matsumoto et al.
6,665,508 B2 12/2003 Sudo et al.
6,775,503 B2 8/2004 Hattori et al.
6,826,381 B2 11/2004 Muramatsu et al.
6,898,407 B2 5/2005 Noguchi et al.
6,937,838 B2 8/2005 Ishii et al.
7,043,173 B2 5/2006 Grune et al.
7,313,349 B2 12/2007 Suzuki et al.
7,321,744 B2 1/2008 Hosokawa et al.
2002/0102112 A1 8/2002 Hung-Hsu
2002/0102113 A1 8/2002 Kusano et al.
2003/0116923 A1 6/2003 Meetze et al.
2003/0117892 A1 6/2003 Litwiller
2003/0156861 A1 8/2003 Nagano et al.
2004/0009015 A1 1/2004 Fujimori et al.
2004/0096239 A1 5/2004 Hosokawa et al.
2004/0126150 A1 7/2004 Noguchi et al.
2004/0131381 A1 7/2004 Kawasumi et al.
2004/0165913 A1 8/2004 Hattori
2004/0170446 A1 9/2004 Nagashima et al.
2004/0170447 A1 9/2004 Arai et al.
2004/0184841 A1 9/2004 Tsuda et al.
2004/0208676 A1 10/2004 Ishii et al.
2004/0223790 A1 11/2004 Hosokawa et al.
2004/0240908 A1 12/2004 Deguchi et al.
2004/0258432 A1 12/2004 Hattori et al.
2004/0265011 A1 12/2004 Tsuda et al.
2005/0008393 A1 1/2005 Kuma et al.
2005/0008398 A1 1/2005 Hattori
2005/0036810 A1 2/2005 Murakami et al.
2005/0084293 A1 4/2005 Fukuchi et al.
2005/0158071 A1 7/2005 Hosokawa et al.
2005/0169653 A1 8/2005 Noguchi et al.
2005/0196199 A1 9/2005 Hattori
2005/0226656 A1 10/2005 Tsuda et al.
2006/0034642 A1 2/2006 Taguchi et al.
2007/0077100 A1 4/2007 Suzuki et al.

FOREIGN PATENT DOCUMENTS

EP 0 435 596 7/1991
EP 616268 A1 9/1994
EP 0 779 561 6/1997
EP 0 801 337 10/1997
EP 1 022 620 7/2000
EP 1 120 691 8/2001
EP 1 220 051 7/2002
JP 60-146265 8/1985
JP 04-000477 1/1992
JP 04-123074 4/1992
JP 06-59576 3/1994
JP 06-110331 4/1994
JP 06-266227 9/1994
JP 7-20705 1/1995
JP 07-043999 2/1995
JP 08-137176 5/1996
JP 09-90727 4/1997
JP 09-160364 6/1997
JP 9-251240 9/1997
JP 09-311535 12/1997
JP 10-63084 3/1998
JP 10-142913 5/1998
JP 11-184232 7/1999
JP 2000-105494 4/2000
JP 2000-172058 6/2000
JP 2000-172059 6/2000
JP 2000-187378 7/2000
JP 2000-221766 8/2000
JP 2000-275941 10/2000
JP 3120723 10/2000
JP 2000-310901 11/2000
JP 2000-338758 12/2000
JP 2001-5286 1/2001
JP 2001-27839 1/2001
JP 2001-125359 5/2001
JP 2001-265102 9/2001
JP 2002-6601 1/2002
JP 2002-139905 5/2002
JP 2002-169365 6/2002
JP 2002-221858 8/2002
JP 2002-244359 8/2002
JP 2002-268357 8/2002
JP 2002-268295 9/2002
JP 2002-276466 9/2002
JP 2002-357945 12/2002
JP 3384914 12/2002
JP 2004-139031 5/2004
WO WO 2004/077170 9/2004

WO WO 2005/076089 8/2005

OTHER PUBLICATIONS

Patent Abstracts of Japan, JP 09-244369, Sep. 19, 1997.
Patent Abstracts of Japan, JP 2000-214669, Aug. 4, 2000.
Patent Abstracts, JP 11-288157, Oct. 19, 1999.
Patent Abstracts of Japan, JP 11-202606, Jul. 30, 1999.
U.S. Appl. No. 12/059,392, filed Mar. 31, 2008, Takeyama et al.
U.S. Appl. No. 12/166,951, filed Jul. 2, 2008, Miyamoto et al.
U.S. Appl. No. 12/238,815, filed Sep. 26, 2008, Utsunomiya et al.

* cited by examiner

DEVELOPER CONTAINER, DEVELOPER SUPPLYING DEVICE, AND IMAGE FORMING APPARATUS

CROSS-REFERENCE TO RELATED APPLICATIONS

This application is a Division of and claims the benefit of priority under 35 U.S.C. §120 from U.S. Ser. No. 10/864,672 filed Jun. 10, 2004 which is a continuation of PCT/JP04/02025 filed Feb. 20, 2004, and claims the benefit of priority under 35 U.S.C. §119 from Japanese Patent Application Nos. 2003-052658 filed Feb. 28, 2003, 2003-054478 filed Feb. 28, 2003, and 2004-004668 filed Jan. 9, 2004, the entire contents of each of which are incorporated herein by reference.

BACKGROUND OF THE INVENTION

1. Field of the Invention

The present invention relates to a developer container which accommodates a developer, and to a developer supplying device which supplies a developer, such as toner, to a developer receiving device, such as a visible image formation unit that forms a visible image on an image supporting medium such as a photoconductor. Moreover, the present invention relates to an image forming apparatus, such as a copier, a printer, a facsimile, etc., which uses the developer container and the developer supplying device.

2. Description of the Related Art

Conventionally, it is known that a cylindrical toner bottle is used as a developer container which is provided in a developer supplying device which supplies a developer, such as toner, to a developing device of an image forming apparatus, such as a copier, a printer, a facsimile.

The toner bottle is provided with a spiral projection disposed in the inner wall of the toner bottle and a bottle gear for rotating the toner bottle. The developer, such as toner, inside the toner bottle is discharged from the toner bottle by rotation of the toner bottle through the gear, and the discharged developer is conveyed to the developing device, so that the developing device is supplied with the developer.

However, even if the toner guide is provided in the developer container in which the gear is provided on the side surface of the developer container near the opening of the toner, there is the problem that discharging of the toner by the rotation of the developer container in the circumferential direction thereof may not be performed smoothly.

The bottle gear provided in the toner bottle as the developer container is configured in a ring-like formation in which a central opening is formed on the inside peripheral surface of the gear. When the diameter of the opening is smaller than the inner diameter of the inner wall of the toner bottle at the position where the gear is provided, the inner wall of the toner bottle is provided with a raised portion which is raised from the position of the bottle gear.

Since the toner bottle is laid horizontally in the image forming apparatus, if the raised portion of the inner wall is at the intermediate portion before the position where the toner inside the bottle arrives at the toner outlet, the toner inside the bottle cannot be transferred beyond the raised portion and cannot reach the toner outlet. For this reason, there is the case in which discharging of the toner may be performed smoothly.

A conceivable method to overcome the problem is to make the diameter of the opening of the bottle gear larger than the inner diameter of the inner wall of the toner bottle. For example, the diameter of the opening of the gear may be made to equal to the inner diameter of the inner wall of the toner bottle.

However, in such a case, there is a certain amount of distance from the opening of the gear to the dedendum of the gear teeth, and the gear tooth will project from the peripheral side surface of the toner bottle in the direction normal to the bottle peripheral surface. Then, the image forming apparatus in which the toner bottle is provided will require the space for accommodating the bottle gear rotatably inside the apparatus, in addition to the space for accommodating the toner bottle inside the apparatus. This makes the image forming apparatus to be enlarged in size.

Therefore, in order for the miniaturization of the image forming apparatus, it is desirable that toner supply can be performed smoothly even when the diameter of the opening of the bottle gear is smaller than the inner diameter of the inner wall of the toner bottle.

Japanese Laid-Open Patent Application Nos. 10-063084, 07-020705 and 09-251240 disclose some toner bottles which are a developer container and provided to be detachably attached to the toner supply device of the main part of the image forming apparatus in the longitudinal direction of the apparatus. In the conventional devices of the above-mentioned documents, the toner bottle is detachably attached from the front side of the image forming apparatus, or the cartridge accommodating the toner bottle therein is detachably attached from the front side of the apparatus main part.

Moreover, in order to carry out the rotation drive of the toner bottle, the conventional devices of the above-mentioned documents have the following mechanisms.

In the device of Japanese Laid-Open Patent Application No. 10-063084, the bottom of the toner bottle is connected with the drive unit provided on the rear side plate of the apparatus main part so that the rotation drive of the toner bottle is carried out.

In the device of Japanese Laid-Open Patent Application No. 07-020705, the engagement unit provided near the shoulder of the toner bottle is connected with the drive unit provided in the apparatus main part, so that the rotation drive of the toner bottle is carried out.

In the device of Japanese Laid-Open Patent Application No. 09-251240, the bottle gear is provided near an end of the toner bottle opposite to another end of the toner bottle where the toner outlet is formed, and the bottle gear is engaged with the drive gear so that the rotation drive of the toner bottle is carried out.

As described above, in the devices of the above-mentioned documents, the toner bottle or the cartridge which accommodates the toner bottle is detachably attached from the front side of the apparatus main part, and the operation space in the case of the attachment and detachment will be needed at the front side of the apparatus, and it will be necessary to take many installation area of the apparatus.

Moreover, in the composition in which the developer container is detachably attached from the front side of the apparatus main part, the operator has to lean over in front of the apparatus, and has to perform the toner bottle exchange, or in order to detach the used developer container from the apparatus main part in the state where the toner outlet opened, the operator has to consider so that the remaining toner may not leak from the opening and the front of the apparatus may not be polluted.

From the above reasons, the attachment/detachment method of the developer container from the front side of the apparatus must be taken into consideration.

Moreover, it is demanded that the operator can easily perform developer container exchange, with the spread of color image forming apparatuses in recent years, and it is necessary to make the attachment/detachment operation of the developer container easy.

If the developer container can be detachably attached from the upper part of the main part of the apparatus apart from the above conventional method of detaching and attaching the developer containers from the front of the apparatus, what is necessary is opening the top cover of the main part of the apparatus in the case of developer container attachment and detachment, and exchange removing the developer container of the required color from the upper part, and just coming to set the new developer container.

Therefore, it is no longer necessary to take the operation space in the installation area of the apparatus as in the conventional method of attachment and detachment of the developer container from the front of the apparatus, and it is possible to reduce the installation area.

Moreover, since attachment/detachment operation can be performed being able to exchange the developer container, with the operator standing, and looking at the developer container and it is easy to protect that the toner from developer container opening begins to leak, and the attachment/detachment operation becomes easy.

From the above reason, the developer container attachment and detachment from the upper part of the apparatus main part can also make the operation easy, and it is possible to reduce the installation area of the apparatus. This is desirable.

Moreover, although the miniaturization of the apparatus is being called for in recent years, in order to miniaturize the apparatus, what is taken into consideration also about the configuration of the drive unit which drives the developer container is searched for.

However, in the device of Japanese Laid-Open Patent Application No. 10-063084, the engagement unit with the main part side drive unit of the apparatus in the toner bottle is provided in the direction end of the toner bottle length, and the position in which the drive unit is formed consists of this bottle the back side further in the direction of the length of the toner bottle.

For this reason, the total length of the depth of the drive unit and the length of the toner bottle in the longitudinal direction will be needed for the depth of the apparatus, and the length of the apparatus will be enlarged.

If the peripheral side surface of the toner bottle is adjoined as in the devices of Japanese Laid-Open Patent Application Nos. 07-020705 and 09-251240 and the input unit of driving force is provided, the necessity of arranging in order and providing the drive unit and the bottle in the direction of the bottle length will be lost, and it is possible to prevent enlargement of the depth of the apparatus. The apparatus can be miniaturized, and it is desirable.

If the input unit of driving force is provided in the side surfaces other than the direction end of the length of the developer container from the upper part of the apparatus while enabling the developer container attachment/detachment from the apparatus upper part, the advantages of space saving at the time of attachment and detachment, improvement in the attachment/detachment operation, and many further called the miniaturization of the apparatus can be obtained, and the usefulness is high.

Moreover, in the conventional device, the developer container, such as the toner bottle, is provided so that the developer container is detachably attached to a container mounting unit of the developer supplying device.

In the conventional device, after removing the used developer container which is empty with consumption of the developer from the container mounting unit, the developer can be replaced with the image forming apparatus to the developer receiving device, such as the visible image formation unit, by setting the new developer container.

In the above developer supplying device, the developer in the developer container is moved to the outlet as such a developer supplying device using conveyance drive components, such as the agitator provided in the main part of the container, as disclosed in Japanese Laid-Open Patent Application No. 2002-357945.

Moreover, the spiral projection is formed in the inner wall of the elongated main part of the container which accommodates the developer inside, and the internal developer is moved to the outlet by rotating the main part of the container so that the central axis extending in the longitudinal direction may turn into the center-of-rotation axis, as disclosed in Japanese Laid-Open Patent Application No. 2000-338758.

In the developer supplying device of Japanese Laid-Open Patent Application No. 2000-338758, the spiral projection formed in the wall in the main part of the container is moved with the rotation of the main part of the container, and the internal developer is moved to the outlet by the movement of the spiral projection.

Similar to the developer supplying device of Japanese Laid-Open Patent Application No. 2000-338758, the applicant to which the present invention is assigned has proposed the image forming apparatus equipped with the developer supplying device in which the main part of the container is rotated, and the internal developer is moved to the outlet by the rotation of the container main part, as disclosed in Japanese Patent Application No. 2002-276466. Japanese Patent Publication 2004-139031, published on May 13, 2004, claimed priority from Japanese Patent Application 2002-276466, which was abandoned and never published.

In the above-mentioned image forming apparatus, the toner bottle as shown in FIG. 32A, which is a developer container, is used. In the toner bottle 632 of FIG. 32A, the cap portion 634, which is a rotation unit, is provided at the leading end of the main part 633 of the toner bottle 632.

Moreover, the toner outlet (not shown) opens to a part of the peripheral side surface of the cap portion 634, and this toner outlet is closed with the shutter 636 in the state of FIG. 32A.

This shutter 636 is attached to the peripheral side surface of the cap portion 634 so that it is slidable on the peripheral side surface of the cap portion 634.

Moreover, in order to allow the cap portion 634 to be rotated around the central axis of the cap portion 634, the handle 635 which is taken by the operator is formed integrally with the cap portion 634. When placing the toner bottle 632 on the bottle holder 631 indicated by the dotted line in FIG. 32A, the toner bottle 632 is laid on the bottle holder 631 as in the state of illustration.

If the direction of the arrow N in FIG. 32A is made to rotate the handle 635, although the cap portion 634 constituted by the handle 635 and one rotates, as for the shutter 636, in contact with shutter stop unit 631*a* of the bottle holder 631, rotation will be prevented from this state.

Thereby, the shutter 636 carries out the slide transfer relatively to the peripheral side surface of the cap portion 634 by the rotation, and the toner outlet is moved so that it faces the bottle holder 631 in the downward perpendicular direction (the underside of FIG. 32A). Therefore, the toner outlet which is in the closed state by the shutter 636 is opened to the perpendicular direction down side.

On the other hand, when removing the toner bottle 632 from the bottle holder 631, the handle 635 is rotated in the reverse direction opposite to the direction of the arrow N in FIG. 32A.

Thereby, the toner outlet also transfers for reverse with rotation of the cap portion 634 with the arrow N in FIG. 32A, and the shutter 636 carries out the slide transfer relatively to the peripheral side surface of cap portion 34Y according to the energization force by the energization unit (not shown).

And the toner outlet is closed by the shutter 636. Therefore, in case the toner bottle 632 is dealt with, the toner does not begin to leak from the toner outlet.

FIG. 32B is a cross-sectional view of the circumference of the cap portion 634 taken along the central axis O of the toner bottle 632 and passing through the toner outlet.

As shown in FIG. 32B, as the cap portion 634 is inserted in the portion of the opening C of the main part 633 of the bottle, it is attached to the main part 633 of the bottle.

And when the toner bottle 632 is set to the bottle holder 631, this cap portion is locked to the bottle holder. Therefore, when it is engaged with the drive gear of the drive motor and the rotation driving force of the drive motor is transmitted to the bottle main part 633 via the bottle gear 637, the main part 633 of the bottle is rotated in the direction of the arrow Q in FIG. 32A with the friction sliding of the bottle gear 637 with the cap portion 634.

However, the lock of the cap portion 634 to the bottle holder 631 may be made with a comparatively weak force in consideration of the ease of operation of the operator who operates the handle 635 of the cap portion 634.

Therefore, if the frictional force between the rotating main part 633 of the bottle and the cap portion 634 exceeds the force to lock the cap portion 634, the cap portion 634 will rotate with the rotation of the main part 633 of the bottle.

Consequently, the toner outlet opened to the perpendicular direction down side is also moved to the direction of the arrow Q in FIG. 32A, and will be in the closed state by the shutter 636. Then, even if the main part 633 of the bottle is rotated to perform toner supply operation, there is the problem that the situation in which toner supply is not actually performed arises.

In addition, if the direction (the direction of the arrow Q in FIG. 32A) of rotation of the main part 633 of the bottle is reversed, the toner outlet will not be closed according to the friction between the main part 633 of the bottle and the cap portion 634, and the above-mentioned problem does not occur.

However, it is necessary to reverse the direction of the rotation drive of the main part 633 of the bottle in this case and the design change relevant to the composition of the toner feeder and the whole image forming apparatus is obliged, and it may be difficult to adopt such composition.

Moreover, since the direction of the spiral toner guide 633*a* currently formed in the inner wall of the main part 633 of the bottle in this case must be reversed by the design change, there is also the disadvantage that it is impossible to use the toner bottle before design change.

On the other hand, if the direction (the direction of the arrow N in FIG. 32A) in which the shutter 636 is displaced relative to the cap portion 634 when changing the toner outlet to the closed state is reversed, the above-mentioned problem does not occur.

However, it will be necessary to change the composition of the toner feeder relevant to the shutter in this case, and it may be difficult to adopt such composition.

Moreover, since the cap portion 634 will also be subjected to the composition change in this case, there is also the disadvantage that it is impossible to use the toner bottle before design change.

Moreover, if the toner bottle 632 is provided such that the cap portion (rotation unit) 634 may be rotated in the first direction (which is opposite to the second direction in which the shutter 636 opens the toner outlet), the operator may rotate, when attaching the toner bottle 632 to the bottle holder 631, the cap portion (rotation unit) 634 in the first direction accidentally. In this case, there is the possibility of the incorrect setting of the cap portion 634.

Moreover, if the toner bottle 632 is provided such that the cap portion 634 may be rotated further after the toner outlet is opened by the shutter 636 through the operator's proper rotation of the cap portion 634 in the second direction when attaching the toner bottle 632 to the bottle holder 631, the cap portion 634 will be excessively rotated. In this case, there is the possibility of the falling out of the shutter 636 may arise.

SUMMARY OF THE INVENTION

In order to overcome the above-described problems, the first aspect of the present invention is to provide an improved developer container for use in an image forming apparatus in which toner supply can be carried out smoothly, while realizing improvement in the attachment/detachment operation of the developer container to the main part of the image forming apparatus, and the miniaturization of the image forming apparatus.

The second aspect of the present invention is to provide a developer container and a developer supplying device using the developer container, which can prevent the plugging of the toner outlet by the shutter with the rotation of the container main part, while making the design change unnecessary and avoiding the above-described problems.

The third aspect of the present invention is to provide a developer container for use in an image forming apparatus in which incorrect setting of the developer container can be prevented and the problem of the excessive rotation of the cap portion arising when the shutter is caused to open the toner outlet can be overcome.

The above-mentioned objects of the present invention are achieved by a cylindrical developer container which has a main part accommodating a developer therein and is detachably attached to an image forming apparatus, the developer container comprising: an outlet provided at a side of the developer container to discharge the developer in the developer container; an input unit provided adjacent to the outlet and having a small-diameter portion an inside diameter of which is smaller than a diameter of the container main part, wherein, when the container is attached to the image forming apparatus, the input unit is engaged with a drive motor of the image forming apparatus to receive a rotating force of the drive motor; and a developer guiding unit which causes the developer inside the developer container to be moved to the outlet beyond the small-diameter portion of the input unit by rotation of the developer container.

The above-mentioned objects of the present invention are achieved by an image forming apparatus comprising: an image supporting medium; a visible image formation unit forming a visible image on the image supporting medium; a developer supplying device supplying a developer to the visible image formation unit; a developer container; a container mounting unit to which the developer container is attached; and a drive unit rotating the developer container in a circumferential direction of the developer container, wherein the developer container comprises: a main part accommodating the developer therein; an outlet provided at a side of the developer container to discharge the developer in the developer container; an input unit provided adjacent to the outlet and having a small-diameter portion an inside diameter of which is smaller than a diameter of the container main part, wherein, when the container is attached to the image forming apparatus, the input unit is engaged with a drive motor of the image forming apparatus to receive a rotating force of the drive motor; and a developer guiding unit which causes the developer inside the developer container to be moved to the outlet beyond the small-diameter portion of the input unit by rotation of the developer container.

The above-mentioned objects of the present invention are achieved by a developer supplying device which includes a developer container having a main part accommodating a developer therein and having an opening at an end surface of the container main part, and a rotation unit attached to the container main part to cover the opening and having an outlet provided on a circumferential surface of the rotation unit and communicating with the opening, wherein the developer in the container main part is moved to the opening and discharged from the outlet when the container main part, attached to a container mounting unit, is rotated around a longitudinal axis of the container main part, so that the developer supplying device supplies the developer discharged from the developer container to a developer receiving device, wherein the developer container comprises a shutter provided on the rotation unit to open or close the outlet by a movement of the shutter relative to the rotation unit in a rotation direction of the container main part, the developer supplying device is provided to apply a frictional force to the shutter or the rotation unit to cause the relative movement of the shutter and the rotation unit in a direction to close the outlet during the rotation of the container main part, and the developer supplying device comprises a regulation unit regulating the relative movement of the shutter and the rotation unit in the direction to close the outlet, by using the frictional force with the container main part when the container main part is rotated to discharge the developer from the outlet.

The above-mentioned objects of the present invention are achieved by an image forming apparatus comprising: a visible image formation unit forming a visible image on an image supporting medium; and a developer supplying device which includes a developer container having a main part accommodating a developer therein and having an opening at an end surface of the container main part, and a rotation unit attached to the container main part to cover the opening and having an outlet provided on a circumferential surface of the rotation unit and communicating with the opening, wherein the developer in the container main part is moved to the opening and discharged from the outlet when the container main part, attached to a container mounting unit, is rotated around a longitudinal axis of the container main part, so that the developer supplying device supplies the developer discharged from the developer container to a developer receiving device of the visible image formation unit, wherein the developer container comprises a shutter provided on the rotation unit to open or close the outlet by a movement of the shutter relative to the rotation unit in a rotation direction of the container main part, the developer supplying device is provided to apply a frictional force to the shutter or the rotation unit to cause the relative movement of the shutter and the rotation unit in a direction to close the outlet during the rotation of the container main part, and the developer supplying device comprises a regulation unit regulating the relative movement of the shutter and the rotation unit in the direction to close the outlet, by using the frictional force with the container main part when the container main part is rotated to discharge the developer from the outlet.

The above-mentioned objects of the present invention are achieved by a cylindrical developer container which has a main part accommodating a developer therein and is detachably attached to an image forming apparatus, the developer container comprising: a rotation unit which is rotatable relative to the container main part; an outlet provided on the rotation unit to discharge the developer in the developer container; a shutter provided on the rotation unit to open or close the outlet by rotation of the rotation unit when the container is attached to the image forming apparatus; and an engagement unit provided on a peripheral side portion of the rotation unit, the engagement unit being engaged with the image forming apparatus to prevent rotation of the rotation unit.

The above-mentioned objects of the present invention are achieved by a cylindrical developer container which has a main part accommodating a developer therein and is detachably attached to an image forming apparatus, the developer container comprising: a rotation unit which is rotatable relative to the container main part; an outlet provided on the rotation unit to discharge the developer from the container; a shutter provided on the rotation unit to open or close the outlet by rotation of the rotation unit; a first rotation preventing unit provided on the rotation unit to prevent the rotation unit from being rotated in a first direction when the container is attached to the image forming apparatus; and a second rotation preventing unit provided on the rotation unit to prevent the rotation unit from being rotated further in a second direction opposite to the first direction after the rotation unit is rotated in the second direction by the attachment of the container to the image forming apparatus and the shutter is caused to open the outlet by the rotation of the rotation unit.

According to the developer container of the present invention, it is possible to provide an image forming apparatus in which toner supply can be carried out smoothly, realizing improvement in the attachment/detachment operation of the developer container to the image forming apparatus, and the miniaturization of the image forming apparatus.

Moreover, according to the image forming apparatus of the present invention, it is possible to perform toner supply smoothly, realizing improvement in the attachment/detachment operation of the developer container to the image forming apparatus, and the miniaturization of the image forming apparatus.

Moreover, according to the developer supplying device and the image forming apparatus of the present invention, it is no longer necessary to carry out the design change such that the direction of rotation of the container main part is reversed, or the direction of opening and closing of the shutter in the developer container is revered, while overcoming the above-described problems. In addition, it is possible to prevent the plugging of the toner outlet by the shutter with the rotation of the container main part without causing the above-described problems.

Furthermore, according to the developer container of the present invention, it is possible to prevent the incorrect setting of the developer container and avoid the problem of the excessive rotation of the cap portion arising when the shutter is caused to open the toner outlet.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

A description will now be provided of the preferred embodiments of the present invention with reference to the accompanying drawings.

Hereinafter, the printer in which the electrophotographic printing method is carried out will be explained as an example of the image forming apparatus to which an embodiment (hereinafter called the first preferred embodiment) of the invention is applied. However, the present invention is not limited to the printer in the following description but applicable to another image forming apparatus. In addition, the imaging unit is explained as a process cartridge.

Figure 1:
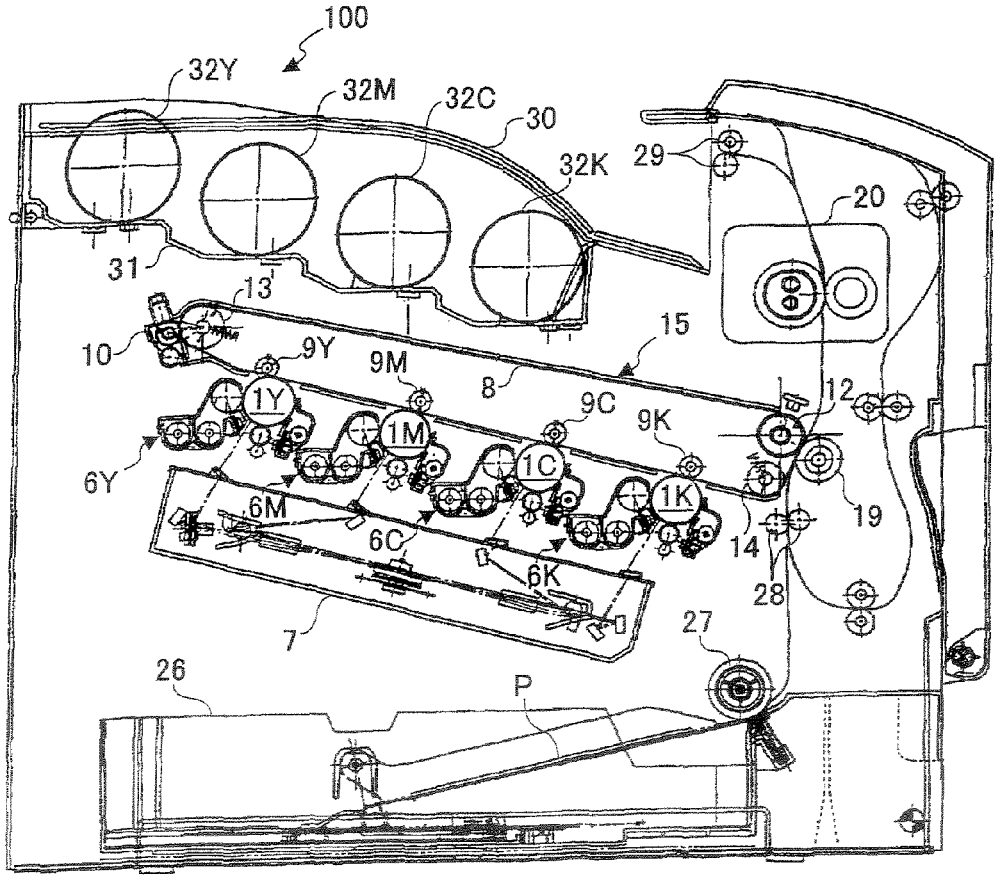
FIG. 1 is a cross-sectional view of a printer to which an embodiment of the developer container of the invention is applied.

First, a description will be given of the composition of the printer. FIG. 1 is a cross-sectional view of the printer to which an embodiment of the developer container of the invention is applied.

The printer 100 is provided with the four process cartridges 6Y, 6M, 6C, 6K which generate the toner images of yellow, magenta, cyan, and black (which are called Y, M, C, and K toner images). The process cartridges respectively use Y, M, C and K toners which are mutually different colors as an image-forming substance, but they have the same composition and are exchanged by the new one at a time of toner replenishment.

Figure 2:
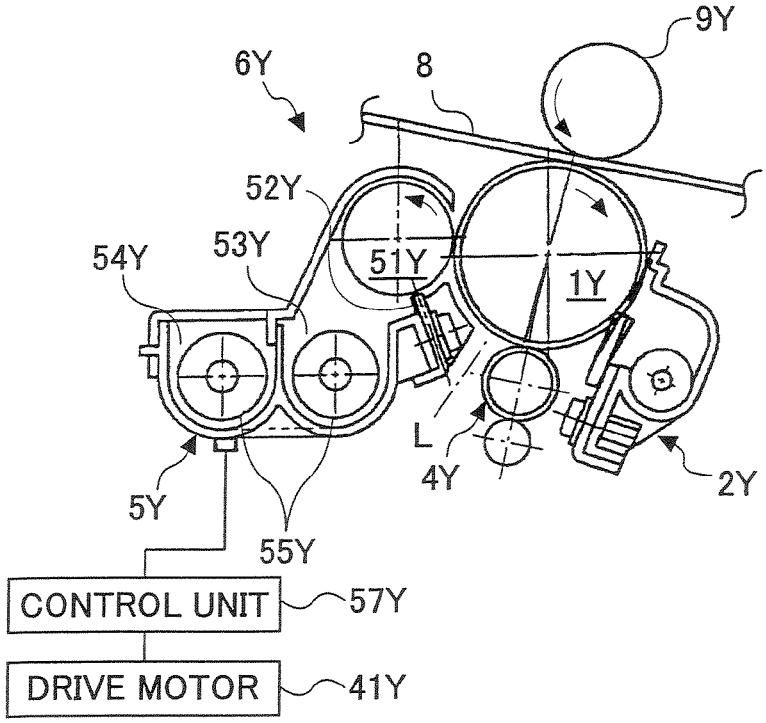
FIG. 2 is an enlarged view of the Y process cartridge in a first preferred embodiment of the invention.

The process cartridge 6Y which generates the Y toner image is considered a representative example of the four process cartridges. As shown in FIG. 2, the process cartridge 6Y includes the drum-like photoconductor 1Y, the drum cleaning device 2Y, the electric discharger (not shown), and the charging device 4Y, and the developing device 5Y.

The process cartridge 6Y is detachably attached to the printer 100 main part, and it is possible to exchange the parts at once.

The above-mentioned charging device 4Y charges uniformly the surface of photoconductor 1Y which is rotated in the clockwise rotation direction by the drive unit (not shown).

The exposure scan is carried out by the laser light L, and the surface of photoconductor 1Y being charged uniformly supports the electrostatic latent image by it.

The electrostatic latent image of the Y is developed by developing-device 5Y which uses Y toner at Y toner image. And the middle transfer is carried out on the middle transfer belt 8. The drum cleaning device 2Y removes the toner which remained on the photoconductor 1Y surface after passing through the middle transfer process.

Moreover, the electric discharger discharges the residual charge of photoconductor 1Y after cleaning. The surface of the photoconductor 1Y is initialized by the electric discharge, and it is prepared for the following image formation.

Also in the other process cartridges 6M, 6C and 6K, the M, C and K toner images are similarly formed on the photoconductors 1M, 1C, and 1K, and the middle transfer is carried out on the middle transfer belt 8.

The exposure device 7 is arranged in each of the lower parts of the process cartridges 6Y, 6M, 6C and 6K shown in FIG. 1. The exposure device 7 which acts as the latent image formation unit irradiates each photoconductor in the process cartridges 6Y, 6M, 6C and 6K, with the laser light L emitted based on image information. The exposure of each photoconductor to the laser light L is carried out. Of the exposure, the electrostatic latent images for Y, M, C, and K are formed on the photoconductors 1Y, 1M, 1C and 1K.

In addition, the exposure device 7 irradiates the photoconductor through two or more optical lenses and mirrors, scanning the laser light (L) emitted from the light source by the polygon mirror which is rotated through the rotation drive motor.

The paper feed unit including the paper accommodating cassette 26 in which the feed roller 27 and the resist roller pair 28 are built is arranged in the bottom portion of the exposure device 7. In the paper accommodating cassette 26, a number of copy sheets P are contained, and the feed roller 27 is in contact with the copy sheet P on the top of the number of copy sheets.

When the feed roller 27 is rotated counterclockwise by the drive unit (not shown), the top copy sheet P is conveyed to the position between the rollers of the resist roller pair 28. Although the resist roller pair 28 carries out the rotation drive of the rollers to clamp the copy sheet P, the rotation drive is stopped immediately. And the copy sheet P is transferred to the secondary transfer nip by the resist roller pair 28 at a suitable timing.

In the above-mentioned paper feed unit, a combination of the feed roller 27 and the resist roller pair 28 (the timing roller pair) is used to constitute the conveyance unit. This conveyance unit conveys the copy sheet P from the paper accommodating cassette 26 to the secondary transfer nip.

The middle transfer unit 15 which carries out the middle image transfer with the endless middle transfer belt 8 (the middle transfer medium) is arranged at the upper part of each of the process cartridges 6Y, 6M, 6C and 6K. This middle transfer unit 15 is provided with the four primary transfer bias rollers 9Y, 9M, 9C and 9K, the cleaning devices 10, and the middle transfer belt 8.

Moreover, the middle transfer unit 15 includes the secondary transfer backup roller 12, the cleaning backup roller 13, the tension roller 14, etc. With the counterclockwise rotation of the middle transfer belt 8, the endless transfer is carried out by the rotation drive of at least one roller of these three rollers.

The primary transfer bias rollers 9Y, 9M, 9C and 9K put the middle transfer belt 8 which carries out the endless transfer in this way between the photoconductors 1Y, 1M, 1C and 1K, and form the primary transfer nip, respectively. In this transfer, the toner impresses the transfer bias of the reversed polarity (for example, plus) to the back surface (the inner surface of the loop) of the middle transfer belt 8. All the rollers except the primary transfer bias rollers 9Y, 9M, 9C and 9K are grounded electrically.

With the endless transfer, the middle transfer belt 8 is the process which passes the primary transfer nip for Y, M, C, and K one by one, and the photoconductors 1Y, 1M, 1C and 1, Y, M and C on K, and K toner image pile it up, and it is transferred the first order.

Thereby, the 4 color superimposed toner image (called the 4 color toner image) is formed on the middle transfer belt 8.

The above-mentioned secondary transfer backup roller 12 puts the middle transfer belt 8 between the secondary transfer rollers 19, and forms the secondary transfer nip in it. The 4 color toner image formed on the middle transfer belt 8 is transferred to the copy sheet P by the secondary transfer nip. The remaining toner which is not transferred to the copy sheet P adheres to the middle transfer belt 8 after passing the secondary transfer nip. The remaining toner is cleaned off by the cleaning device 10.

In the secondary transfer nip, it is inserted between the middle transfer belts 8 and the secondary transfer rollers 19 in which the copy sheet P carries out the surface migration to the forward direction, and the above-mentioned resist roller pair 28 side is conveyed in the opposite direction. In case the copy sheet P sent out from the secondary transfer nip passes through between the rollers of the fixing device 20, the heat and the pressure are fixed to the 4 color toner image transferred by the surface.

Then, the copy sheet P is passed through the rollers of the ejection roller pair 29, and ejected to the outside of the printer. The stack section 30 is provided on the upper surface of the main part of the printer. The copy sheet P ejected from the ejection roller pair 29 outside the printer is stacked on the stack section 30 one by one.

A description will be given of the composition of the developing device 5Y in the above-mentioned process cartridge 6Y.

The developing device 5Y in which the magnetic field generating unit is provided is equipped with the development sleeve 51Y and the doctor 52Y. The doctor 52Y is a developer regulating member which regulates the thickness of the developer supported and conveyed on the development sleeve 51Y. The development sleeve 51Y is a developer support which supports the two-component developer, containing the toner and the magnetic powder, on its surface and conveys the same.

The first axis side developer accommodating portion 53Y which accommodates the developer regulated by the doctor 52Y, without being conveyed to the photoconductor 1Y and the development region which countered is formed in the developer conveyance direction upstream side of the doctor 52Y.

Moreover, at the portion adjacent to the first axis side developer accommodating portion 53Y, the second axis side developer accommodating portion 54Y to which the toner is supplied is formed. The two developer conveyance screws 55Y for carrying out agitating and conveyance of the developer is provided in each of the first axis side developer accommodating portion 53Y and the second axis side developer accommodating portion 54Y, respectively.

Next, a description will be given of operation of the developing device.

In the above-mentioned developing-device 5Y, the developer layer is formed on the development sleeve 51Y. Moreover, the second axis side of the developer conveyance screws 55Y is supplied with the toner, the agitating and conveyance is carried out, and the toner is mixed into the developer.

The mixing of the toner is performed so that the concentration of the toner in the developer falls within a range of a predetermined toner concentration. The toner incorporated in the developer is charged by the frictional charging with the carrier. The developer containing the charged toner is supplied to the surface of the development sleeve 51Y which has the magnetic pole inside, and is supported by the magnetic force. The developer layer supported on the development sleeve 51Y is conveyed in the direction indicated by the arrow in FIG. 2 with the rotation of the development sleeve 51Y.

After the thickness of the developer layer is regulated by the doctor 52Y, it is conveyed to the development region which counters the photoconductor 1Y. In the development region, the development based on the latent image formed on the photoconductor 1Y is performed. The remaining developer on the development sleeve 51Y is conveyed to the upstream portion in the developer conveyance direction of the first axis side developer accommodating portion 53Y with the rotation of development sleeve 51Y.

As previously described with reference to FIG. 1, the bottle holder 31 is arranged between the middle transfer unit 15 and the stack unit 30 which is provided at the upward portion of the middle transfer unit 15. The bottle holder 31 accommodates the Y, M, C, K toner bottles 32Y, 32M, 32C, 32K which are the developer containers which accommodate the Y, M, C, K toners therein.

The toner bottles 32Y, 32M, 32C and 32K are arranged on the bottle holder 31 so that they are stacked from the top. The Y, M, C, K toners in the toner bottles 32Y, 32M, 32C, 32K are suitably supplied to the developing devices of the process cartridges 6Y, 6M, 6C, 6K by the toner supply devices, respectively.

The toner bottles 32Y, 32M, 32C, 32K can be attached to and detached from the main part of the printer 100 independently from the process cartridge 6Y, 6M, 6C, 6K, respectively.

Figure 3:
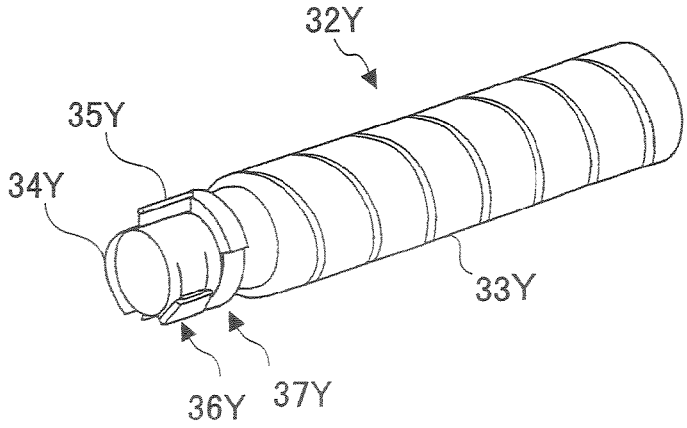
FIG. 3 is a perspective view of the Y toner bottle in the present embodiment.
Figure 4:
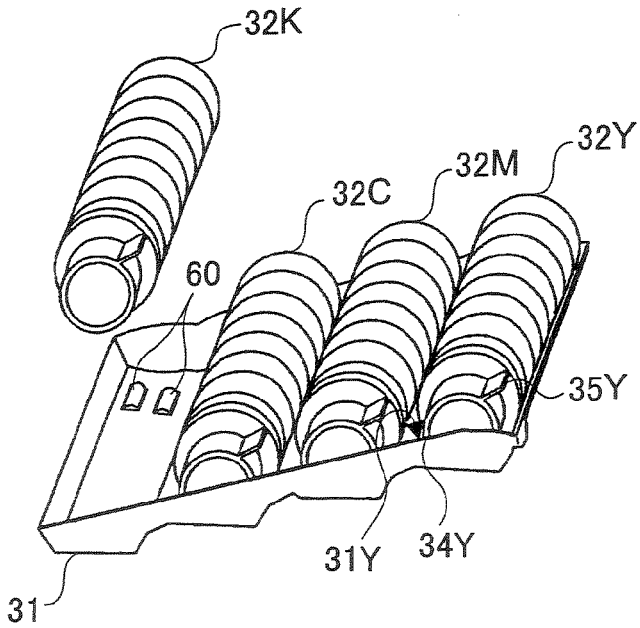
FIG. 4 is a perspective view of the bottle holder and the toner bottles in the present embodiment.

FIG. 3 is a perspective view of the toner bottle 32Y in the present embodiment. FIG. 4 is a perspective view of the bottle holder 31 to which the toner bottles 32Y, 32M, 32C are attached when the toner bottle 32K is further attached.

As shown in FIG. 3, the leading end of the main part 33Y of the toner bottle 32Y is provided with the cap portion 34Y which is a rotation unit which can be rotated relative to the main part 33Y of the toner bottle 32Y. Moreover, the handle 35Y is formed integrally with the cap portion 34Y. Moreover, the bottle gear 37Y, which is the input gear used as the input unit integrally formed with the main part 33Y of the toner bottle, is provided in the vicinity of the position of the main part 33Y of the toner bottle where the cap portion 34Y is attached.

When attaching the toner bottle 32Y to the main part of the printer 100, the stack section 30 shown in FIG. 1 is first opened, and the bottle holder 31 is exposed. And as shown in FIG. 4, after the toner bottle 32Y is placed on the bottle holder 31, the above-mentioned handle 35Y is rotated. Then, the cap portion 34Y which is integrally formed with the handle 35Y is rotated, and the cap portion 34Y and the bottle holder 31 are engaged together and fixed at the same time the shutter 36Y (which is the cover member) is moved in the circumferential direction of the cap portion 34Y to open the toner outlet (not shown) of the toner bottle to the outside thereof. A more detailed description of the toner bottle according to the present invention will be given later.

On the other hand, when removing the toner bottle 32Y from the main part of the printer 100, the handle 35Y is rotated in the opposite direction, the engagement of the cap portion 34Y and the bottle holder 31 is canceled, and the shutter 36Y closes the toner outlet of the toner bottle simultaneously.

And the toner bottle 32Y can be removed from the main part of the printer 100 with the handle 35Y being held as it is. Thus, the toner bottle 32Y can be attached to and detached from the top of the main part of the printer 100, and the exchange work of the toner bottle 32Y can be carried out easily. Moreover, the handle 35Y is formed on the cap portion 34Y, and the cap portion 34Y can be easily rotated and fixed to the bottle holder 31 with the handle 35Y.

In addition, in the state in which the toner bottle 32Y is removed from the main part of the printer 100, even if the handle 35 of the cap portion 34Y is rotated, the shutter 36Y is not moved to open the toner outlet. It is possible to prevent the shutter 36Y from opening the toner outlet accidentally and prevent the internal toner from falling when performing the exchange work of the toner bottle 32Y.

Figure 5:
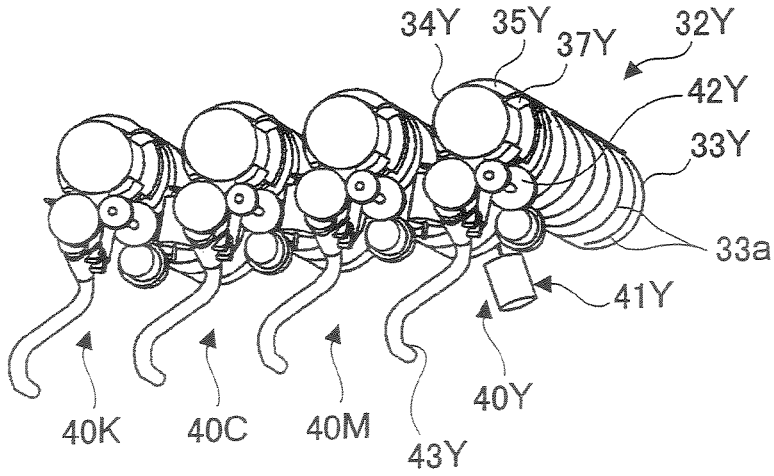
FIG. 5 is a perspective view of the Y, M, C and K toner supply devices in the present embodiment.
Figure 6:
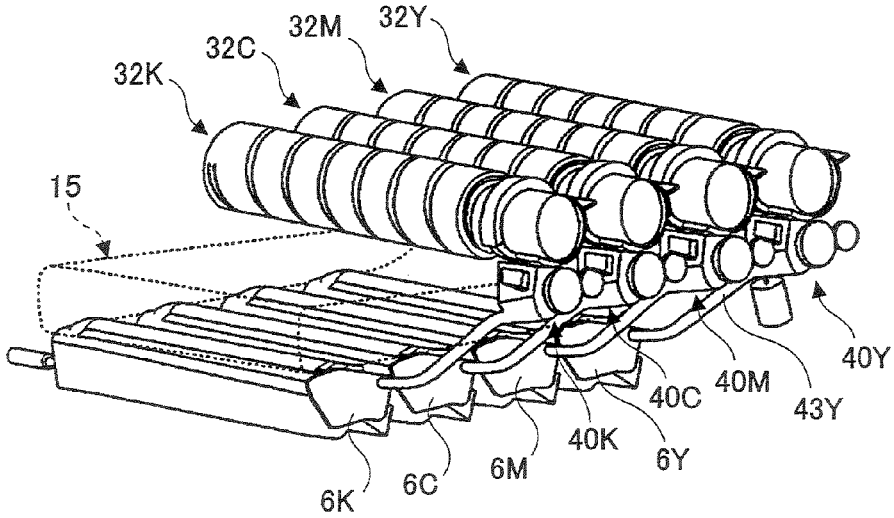
FIG. 6 is a perspective view of the process cartridges and the toner supply devices.

Next, a description will be given of the composition of the toner supply device. FIG. 5 is a perspective view of the Y, M, C and K toner supply devices in the present embodiment. There are shown the toner supply devices 40Y, 40M, 40C and 40K, and the toner bottles 32Y, 32M, 32C and 32K. FIG. 6 is a perspective view of the Y, M, C and K process cartridges and the Y, M, C and K toner supply devices in the present embodiment. The view of FIG. 5 and the view FIG. 6 are seen from different angles.

The toner supply devices 40Y, 40M, 40C and 40K are provided on the side of the middle transfer unit 15, and are provided in the printer 100 main part. For this reason, it is not necessary to provide the toner conveyance unit in the process cartridges 6Y, 6M, 6C, 6K or the toner bottles 32Y, 32M, 32C, 32K, as in the conventional device, and the miniaturization of the process cartridges 6Y, 6M, 6C, 6K, or the toner bottles 32Y, 32M, 32C, 32K can be attained.

Moreover, in the conventional device, the process cartridge and the toner bottle are arranged in the vicinity of each other, and there is the limitation of the design. However, according to the present embodiment, the process cartridge and the toner bottle can be arranged apart from each other. Therefore, the degree of freedom of the design can improve and the miniaturization of the printer can be attained.

Moreover, according to the present embodiment, the toner outlets of the toner bottles 32Y, 32M, 32C, 32K, the toner supply devices 40Y, 40M, 40C, 40K, and the second axis side developer accommodating portions 54Y, 54M, 54C, 54K of the developing devices 5Y, 5M, 5C, 5K are arranged near the end side of the middle transfer unit 15 in the roller shaft direction. Therefore, the toner conveyance distance of the toner supply devices 40Y, 40M, 40C, 40K can be shortened, and it is effective for the miniaturization of the printer and the prevention of the toner clogging during the conveyance.

The toner supply devices 40Y, 40M, 40C and 40K have the same composition, and a description will be given of the composition of the toner supply device 40Y for supplying the Y toner only.

As shown in FIG. 5, the toner supply device 40Y is mainly comprised of the drive motor 41Y, the drive gear 42Y, and the toner conveyance pipe 43Y. The coil (not shown) is installed inside the toner conveyance pipe 43Y. The drive gear 42Y is engaged with the bottle gear 37 of the toner bottle 32Y, and serves as the output gear which rotates the bottle main part 33Y which is rotated integrally with the bottle gear 37 of the toner bottle 32Y, when the drive gear 42Y is rotated by the drive motor 41Y.

When the concentration detection sensor (not shown) which is provided in the developing device 5Y detects shortage of the toner concentration by the second axis side developer accommodating portion 54Y, the drive motor 41Y is rotates in accordance with a toner supply signal output from the control unit 57Y.

The spiral toner guide 33*a* is formed in the inner wall of main part 33Y of the toner bottle, and the internal toner is conveyed by the rotation of the toner bottle from the rear part of the main part 33Y to the front end where the cap portion 34Y is provided. And the toner in the main part 33Y of the toner bottle falls from the toner outlet (not shown) of the cap portion 34Y to the toner receiving portion (not shown) of the toner supply device 40Y.

The toner receiving portion is connected to the toner conveyance pipe 43Y, and the coil (not shown) in the toner conveyance pipe 43Y is rotated simultaneously at the same time the main part 33Y of the toner bottle is rotated, if the drive motor 41Y is rotated. The toner which is supplied to the toner receiving portion by the rotation of the coil is conveyed through the inside of the toner conveyance pipe 43Y, and is supplied to the toner inlet (not shown) of the second axis side developer accommodating portion 54Y of the developing device 5Y. Thus, the toner concentration in the developing device 5Y is adjusted.

In addition, the above-mentioned embodiment in which the concentration detection sensor is used may be modified so that the number of picture elements of an image formed on the photoconductor 1Y is counted using an optical sensor, or the image concentration of a reference image formed in the photoconductor 1Y is measured using a CCD camera. The toner supply may be performed upon the detection of shortage of the toner concentration based on the measurement results using the optical sensor or the CCD camera.

The above discussion deals with an example of the printer to which one embodiment of the present invention is applied.

As described above, even if the toner guide 33*a* is provided in the inner wall of the main part 33Y of the toner bottle, it is found out that the discharge of the toner from the toner outlet may not be performed smoothly by the rotation in the circumferential direction of the toner bottle 32Y. The main reason for this problem is that the inner wall in the bottle is raised and the toner is not easily passed through the raised portion because the diameter of the opening of the bottle gear 37Y provided near the outlet opening of the toner is smaller than the diameter of the inner wall of the toner bottle 32Y.

It is desirable that the bottle gear 37Y is formed so that the gear tooth may not be projected too much from the peripheral surface of the toner bottle 32Y. This is also desirable for the device miniaturization. And it is desirable for stabilization of the toner supply that the bottle gear 37 is provided near the toner outlet. For this reason, even if the diameter of the opening is smaller than the inner diameter of the toner bottle 32Y in the position of the bottle gear 37Y, it is desirable that the toner can smoothly pass through the raised portion of the inner wall of the toner bottle.

In the following, a description will be given of the toner bottle 32Y and the toner supply device using the toner bottle 32Y which allows the toner to smoothly pass through the raised portion of the inner wall of the toner bottle.

Figure 7A:
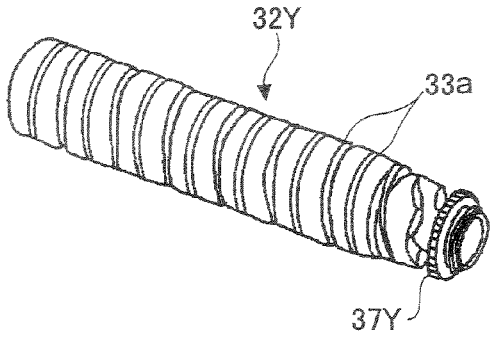
FIG. 7A is a perspective view of an embodiment of the toner bottle in which a resin case is removed.
Figure 7B:
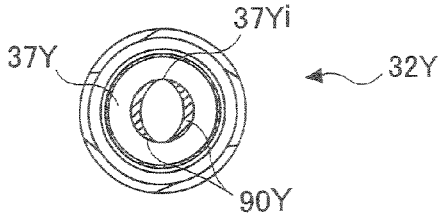
FIG. 7B is a front view of the toner bottle in which the resin case is removed.

FIG. 7A and FIG. 7B are perspective and front views of an embodiment of the toner bottle 32Y in which the resin case is removed. FIG. 7A is a perspective view of the toner bottle 32Y of the present embodiment in which the resin case is removed, and FIG. 7B is a front view of the toner bottle 32Y of the present embodiment in which the resin case is removed.

When the resin case where the toner outlet is provided is removed from the toner bottle 32Y, the bottle gear 37Y will appear near the opening of the toner bottle 32Y. This is because the bottle gear 37Y is integrally molded with the toner bottle 32Y.

As shown in FIG. 7B, when viewing the toner bottle 32Y from the bottle opening side, the portion of the bottle opening which has the smallest inner diameter is the opening (called the gear opening) 37Yi of the bottle gear 37Y.

As indicated by the shaded lines in FIG. 7B, the toner bottle of the present embodiment is provided with the two toner guiding portions 90Y near the gear opening 37Yi, and each toner guiding portion 90Y serves to move the toner inside the toner bottle beyond the raised portion to the toner outlet when the bottle main part is rotated.

The toner guiding portion 90Y is a developer guiding unit which is provided in the developer container of the invention to cause the toner inside the toner bottle to be moved to the toner outlet beyond the small-diameter portion of the bottle gear by rotation of the toner bottle.

A part of the shoulder circlees side whose portion it pushes out and is a part for gear opening 37Yi and the wall in toner bottle 32Y of the near is made to push out to the edge of opening including gear opening 37Yi from the shoulder circles side portion of the larger diameter than the diameter of gear opening 37Yi, the spiral projection is formed, this is pushed out, and it is referred to as the toner guiding portion 90Y.

Figure 8A:
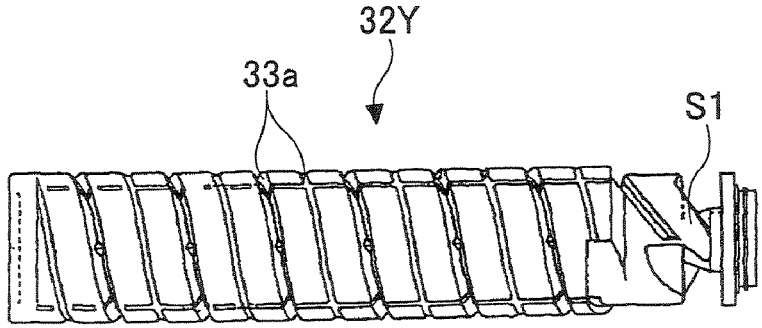
FIG. 8A and FIG. 8B are side views of the toner bottle of the present embodiment.
Figure 8B:
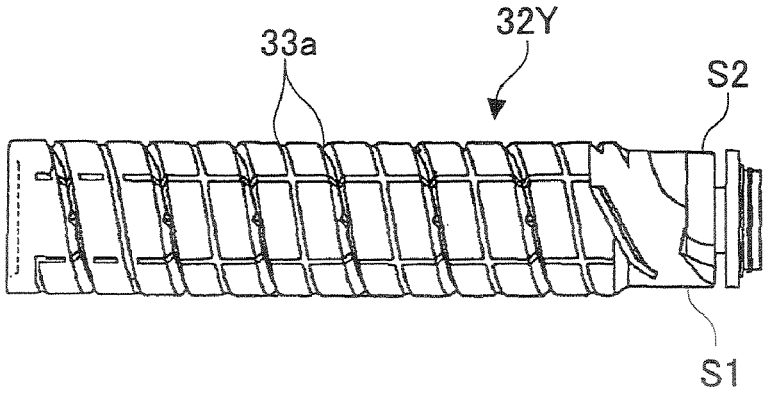

FIG. 8A and FIG. 8B are side views of the toner bottle 32Y in the present embodiment. In FIG. 8A and FIG. 8B, the side surfaces of the toner bottle when viewed in the circumferential directions which are mutually different are shown.

The toner guide 33*a* for the toner delivery is formed by the double helix from the first, and the toner bottle 32Y becomes the form which pushed out in the direction of the centerline of container rotation rather than the edge of gear opening 37Yi in the place where the guide of two reached gear opening 37Yi.

Namely, the toner guide 33*a* is provided with the two toner guiding portions 90Y. As shown in FIG. 7B, in the state in which the resin case is removed, the toner guiding portion 90Y looks like the raised portion in the bottle opening when viewed from the opening front side.

Moreover, in the toner bottle 32Y shown in FIG. 8A and FIG. 8B, at the portion adjacent to the position where the bottle gear 37Y of the toner bottle 32Y is provided, the shoulder unit S of the bottle is provided, and it has the two raised portions S1 and S2.

The raised portions S1 and S2 are the toner conveyance ways by two toners guide 33*a*, and when toner bottle 32Y is seen from outside they are such the two raised portions S1 and S2. The two toner guiding portions 90Y mentioned above are provided along with the raised portions S1 and S2, respectively.

With the use of the toner guiding portion 90Y in the toner guide 33*a*, it is possible that the toner inside the toner bottle to be moved to the toner outlet beyond the small-diameter portion of the bottle gear by rotation of the toner bottle.

Even when the bottle gear 37Y of the byway is provided from the diameter of bottle opening near the toner outlet, it enables the internal toner to transfer to the toner outlet exceeding the gear opening 37Yi by the rotation of the bottle in the circumferential direction thereof.

Figure 9:
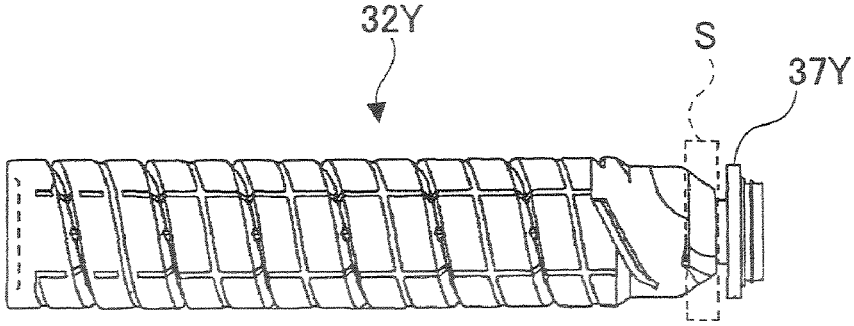
FIG. 9 is a side view of a variation of the toner bottle in the present embodiment of the invention.

FIG. 9 is a side view of a variation of the toner bottle 32Y in the present embodiment of the invention, when viewed from the side surface of the 32Y.

In this modification, the shoulder edge of the two raised portions S1 and S2 in the shoulder unit S of toner bottle 32Y shown in FIG. 8A and FIG. 8B is beveled, and it considers as the shape of a sloping shoulder.

Except having beveled the shoulder unit S, it has the same composition as in FIG. 5A and FIG. 8B, and a description thereof will be omitted.

The toner bottle does not need to have the raised portion like S1 and S2 like the above-mentioned embodiment, and may be sloping-shoulders form as in FIG. 9.

In order for the toner to overcome the gear unit and to discharge it, as shown in FIG. 7B, it is like that the amount which is pushed out inside gear opening core of the toner proposal should just be as in FIG. 9, the toner can be gradually raised from the main part side in shoulder form of FIG. 7B, and the gear unit can also be made to be overcome.

Next, a description will be given of the structure of positioning of the toner bottle 32Y to the bottle holder 31 and the structure of opening and closing of the toner outlet.

FIG. 10A through FIG. 12 are cross-sectional views of the bottle holder 31Y and the toner bottle 32Y respectively.

The engagement wall 38Y, which is a positioning unit which curves in complicated form is made to set up by the nose-of-cam side of cap portion 34Y of toner bottle 32Y.

Figure 10A:
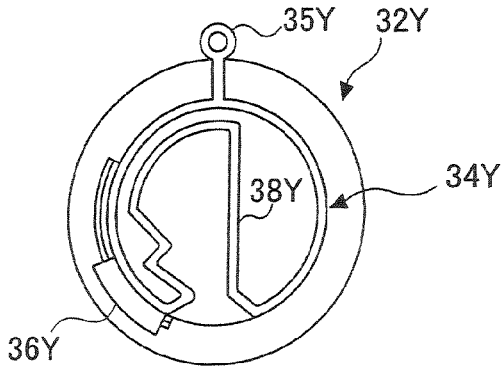
FIG. 10A and FIG. 10B are cross-sectional views of the toner bottle and the bottle holder before attachment of the bottle to the holder.
Figure 10B:
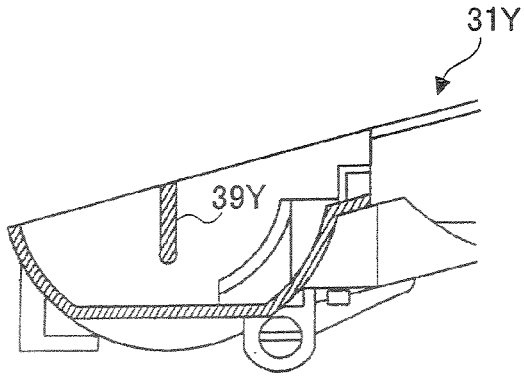

The toner bottle 32Y is the condition in which the handle 35Y is turned to the perpendicular direction bottom, and is laid on bottle holder 31Y (FIG. 10).

This condition is also the condition in which opening of engagement wall 38Y which curves in complicated form is turned to the perpendicular direction bottom.

Figure 11:
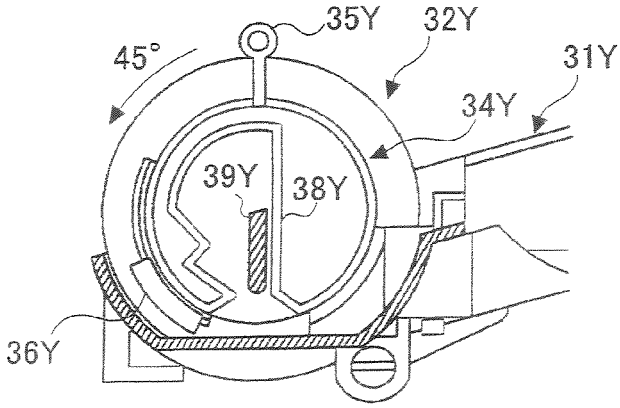
FIG. 11 is a cross-sectional view of the bottle holder to which the toner bottle is attached.

The engagement board 39Y, which is the engagement unit of the bottle holder 31Y, advances into the loop through the opening at engagement wall 38Y of the toner bottle 32Y laid with this condition (FIG. 11).

At this time, not the state where toner bottle 32Y is still set normally but the toner outlet which the cap portion 34Y does not illustrate is closed by shutter 36Y.

Figure 12:
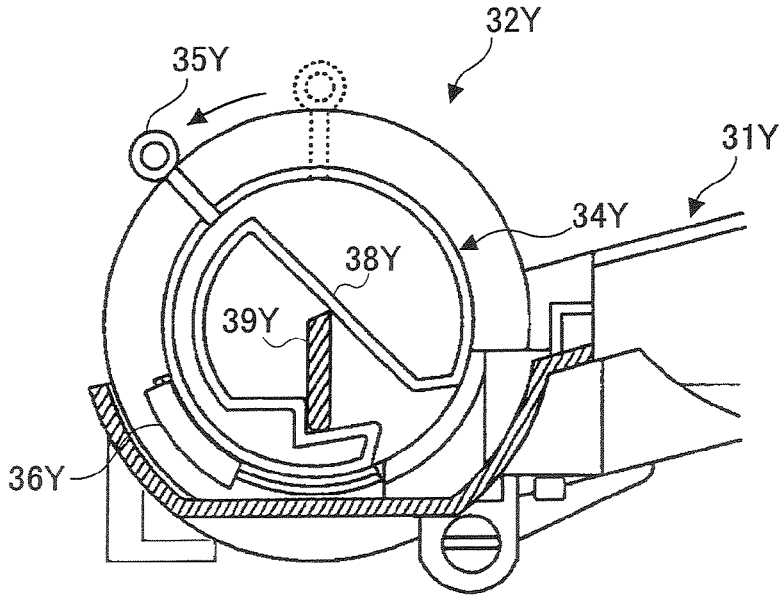
FIG. 12 is a cross-sectional view of the bottle holder with the toner bottle being rotated.

The operator takes the handle 35Y of the toner bottle 32Y laid on bottle holder 31Y, and rotates the handle 35Y counterclockwise by about 45 degrees. Then, although the cap portion 34Y rotates to the counterclockwise rotation in FIG. 12, shutter 36 of cap portion 34Y Y is caught in the bottom of bottle holder 31Y. For this reason, it is possible to prevent rotation of the shutter 36Y only (FIG. 12).

And the toner outlet (not shown) which is closed by the shutter 36Y is exposed, and it is turned to the downward perpendicular direction.

Furthermore, the engagement wall 38Y of the cap portion 34Y is engaged with the engagement board 39Y of the bottle holder 31Y, and the toner bottle 32Y is fixed to the bottle holder 31Y.

In FIG. 4, when making the circumferential direction rotate toner bottle 32Y, the friction arises between the wall in bottle holder 31Y, and the toner bottle outer wall, and rotation may be unable to go easily smoothly.

Then, in the present embodiment, the roller 60, which is a rotation auxiliary unit, is formed in the bottom of bottle holder 31Y. Thereby, rotation of the toner bottle 32Y can be made smooth.

In addition, in the present embodiment, rotation of toner bottle 32Y is made smooth using the roller 60. Alternatively, there is another method for making toner bottle rotation smooth. For example, it is possible to adopt the method of sticking the tape having a good sliding nature to the toner bottle. Such tape is made of a resin material containing fluorine, such as teflon (registered trademark), or containing super-macromolecule polyethylene, etc.

By the way, when making toner bottle 32Y detach and attach from the upper part of the apparatus main part as in the above-mentioned printer, the driving force will be inputted into the input unit of the driving force provided in the toner bottle 32Y side surface from the positions other than the upper part.

When the drive gear of the main part of the apparatus is in the unsuitable position to the input gear as the input unit at this time, rotation becomes unstable gradually with rotation of toner bottle 32Y, and there is a possibility that toner bottle 32Y may lose touch with the input unit.

In order to make it such fault not arise, the following creativity is put in the present embodiment.

Figure 13:
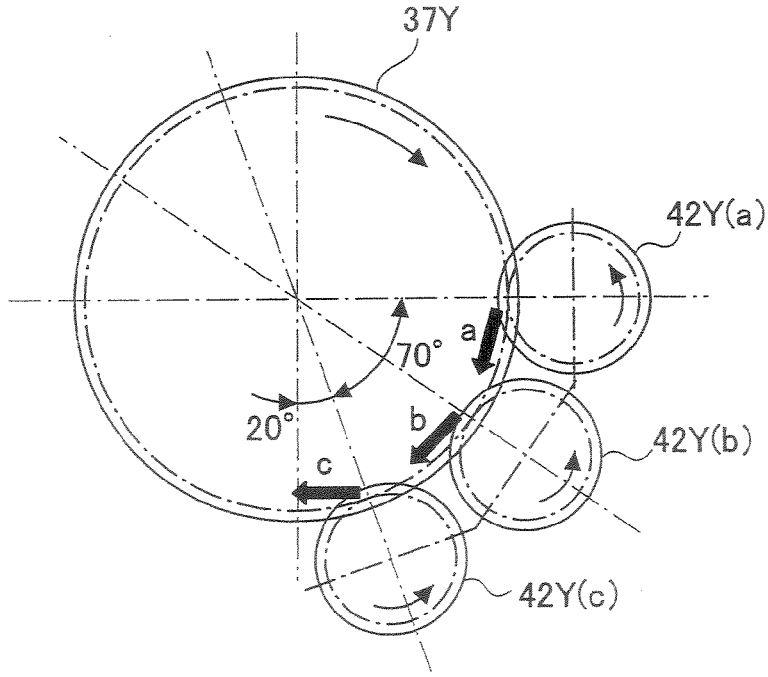
FIG. 13 is a diagram for explaining changes of the position of a drive gear to a bottle gear of the toner bottle.

FIG. 13 is a diagram for explaining the changes of the position of the drive gear 42Y of FIG. 5 to the bottle gear 37Y of the toner bottle 32Y.

As shown in FIG. 13, the pressure angle of the gear is made into 20 degrees. If the drive gear 42Y (a) is placed just beside the bottle gear 37Y so that the revolving shaft of bottle gear 37Y and the revolving shaft of drive gear 42Y are in the horizontal position and the counterclockwise rotation as shown in FIG. 13 is made to rotate the drive gear 42Y, the rotating force of the drive gear 42Y is exerted to the bottle gear 37Y in the direction indicated by the arrow a in FIG. 13, which direction is shifted from the downward perpendicular to the left by 20 degrees in FIG. 13. This is because the pressure angle of the gear is 20 degrees.

Furthermore, if the drive gear 42Y (b) is placed at the slanting position where the axis of drive gear 42Y is located below the axis of bottle gear 37Y, the rotating force of the drive gear 42Y is exerted to the bottle gear 37Y in the direction indicated by the arrow b in FIG. 13, which direction is shifted leftward further from the direction of the arrow a.

Furthermore, if the drive gear 42Y (c) is placed at the further slanting position, the rotating force of the drive gear 42Y is exerted to the bottle gear 37Y in the leftward horizontal direction indicated by the arrow c in FIG. 13. If the drive gear 42Y is placed further below from the position of 42Y (c), the direction of the rotating force of the drive gear 42Y exerted to the bottle gear 37Y will come to be upward, and in this case, there is the possibility that the toner bottle 32Y may come floating.

To overcome the problem, in the present embodiment, the bottle gear 37Y and the drive gear 42Y are positioned so that the direction of the rotating force of the drive gear 42Y exerted to the bottle gear 37Y always faces to the horizontal or downward direction. Specifically, the position of the drive gear 42Y being engaged with the bottle gear 37Y in the present embodiment falls within the range from the position of the drive gear 42Y (a) to the position of the drive gear 42Y (c) in FIG. 13 (or the range of 70 degrees from the horizontal position).

Then, the rotating force is applied in the direction of the respectively thick arrows a and c in each position and the force of going up at least is not applied to bottle gear 37Y, it enables it for toner bottle 32Y not to come floating, but to stabilize and rotate.

As mentioned above, in the present embodiment, the toner guiding portion 90Y, which is a developer guiding unit for causing the toner to be moved to the toner outlet exceeding the gear opening 37Yi, is provided so that the toner guiding portion 90Y is raised from the edge of gear opening 37Yi in the direction of the centerline of toner bottle rotation. It can raise the toner inside the bottle on the gear opening 37Yi which projects from the inside of the toner bottle, and it is possible that the toner is moved beyond the small-diameter portion to the toner outlet.

In the present embodiment, the cap portion 34Y is provided in which relative rotation is possible to the toner bottle 32Y main part, and the engagement wall 38Y as the positioning unit which engages with the engagement board 39Y at the cap portion 34Y is provided.

Since the positioning with the main part of the device of toner bottle 32Y can be easily performed by laying toner bottle 32Y in bottle holder 31Y, and rotating cap portion 34Y from the upper surface of the main part of the printer by this, usability is good.

Moreover, in the present embodiment, the shutter 36Y which opens and closes the toner outlet of the cap portion 34Y is provided, and the shutter is opened synchronizing with toner bottle 32Y being fixed on bottle holder 31Y, and is closed synchronizing with being removed.

The toner leakage which is not expected while special operation for opening and closing of the shutter becomes unnecessary by this and usability becomes high can also be prevented.

Moreover, the toner bottle 32Y in the present embodiment is integrally molded with the bottle gear 37Y. Therefore, as compared with the case where bottle gear 37Y is used as toner bottle 32Y and another object, part mark can be reduced and the cost cut can be aimed at.

In addition, the time and effort in the case of attaching with toner bottle 32Y and bottle gear 37Y can be saved, and it became unnecessary to care the attachment accuracy between toner bottle 32Y and the gear.

Moreover, since it is not necessary to fractionate the toner bottle 32Y and the gear, it is possible to provide good recycle characteristics. Moreover, in the present embodiment, the roller 60 is formed on the bottom of the bottle holder 31Y. Thereby, it can be stabilized and the toner bottle 32Y can be rotated.

In the present embodiment, the drive gear is positioned so that the pressure angle direction which is given from drive gear 42Y to bottle gear 37Y is turned to the horizontal direction or below. It is possible that the toner bottle 32Y does not come floating, and it is possible to stabilize the rotation.

In addition, the same discussion is also applicable to the M, C, K toner bottles of the other toner colors in the printer, not only the Y toner bottle. They have the same composition as that of the Y toner bottle, and the same advantages can be obtained.

Next, a description will be given of the second preferred embodiment of the present invention.

In the present embodiment, the fundamental composition of the printer is essentially the same as that in the previous embodiment, and a description thereof will be omitted.

Next, a description will be given of an example of the toner supplying device of the invention.

Figure 14:
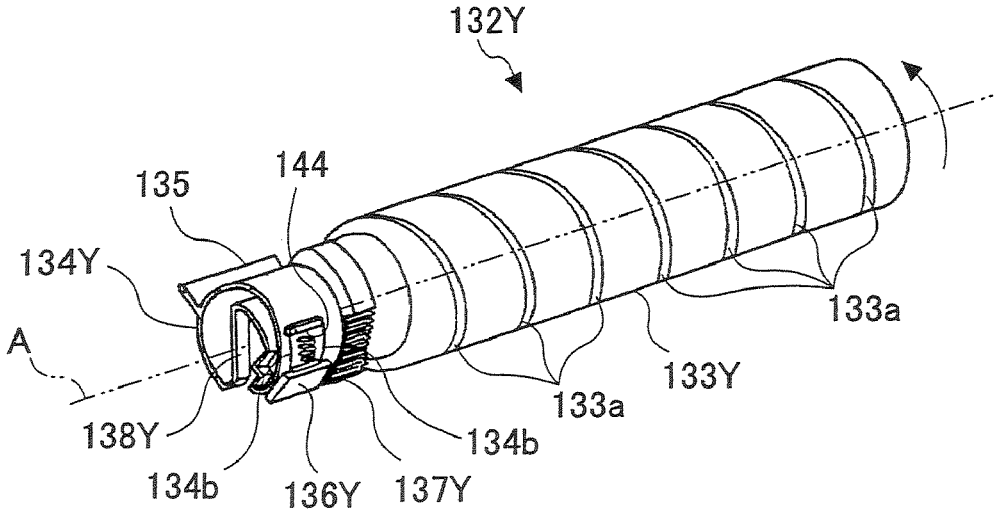
FIG. 14 is a perspective view of an embodiment of the toner bottle in a second preferred embodiment of the invention.

FIG. 14 is a perspective view of an embodiment of the toner bottle 132. Except that the colors of the toner accommodated inside differ, since it has same composition, hereinafter, the toner bottle 132Y for Y toner is described as the example, and each toner bottles 132Y, 132M, 132C, and 132K are explained.

The toner bottle 132Y is equipped with the bottle main part 133Y which accommodates the developer inside and which is the long picture main part of the container.

The bottle main part 133Y has the opening (not shown) in the direction end side of the length, and cap portion 134Y which is the rotation unit is attached so that the opening may be covered.

The cap unit 134Y has the toner outlet (not shown) which is the outlet which is open to the opening of the bottle main part 133Y in the peripheral surface (hereinafter, the peripheral surface in this direction is called "peripheral surface", and the end surface in the longitudinal direction is called "end surface") of the toner bottle 132Y in the direction which is perpendicular to the above-mentioned longitudinal direction.

In the state of FIG. 14, the toner outlet is closed by the shutter 136Y, although it is not illustrated.

The bottle main part 133Y is a hollow cylindrical component opened by the above-mentioned opening. Embossing of the bottle main part 133Y is carried out so that the spiral toner guide 133*a* which turns the peripheral surface inside from the outside, and projects may meet the circumference side.

Moreover, the bottle gear 137Y which is engaged with the drive gear of the toner supply device is integrally formed with the bottle main part 133Y.

The bottle gear 137Y has several gear teeth over the whole region of the circumference of the bottle main part 133Y. When the rotating force of the drive gear of the toner supply device is transmitted to the bottle gear 137Y, the bottle gear is rotated in the direction of the arrow of FIG. 14 around the central axis A extending in the longitudinal direction of the bottle main part 133Y as the center-of-rotation axis. Thereby, the Y toner in the bottle main part 133Y is moved to the cap portion 134Y through the toner guide 133*a*. And the toner from the inside of the bottle main part 133Y is moved into the cap portion 134Y through the above-mentioned opening.

Figure 15:
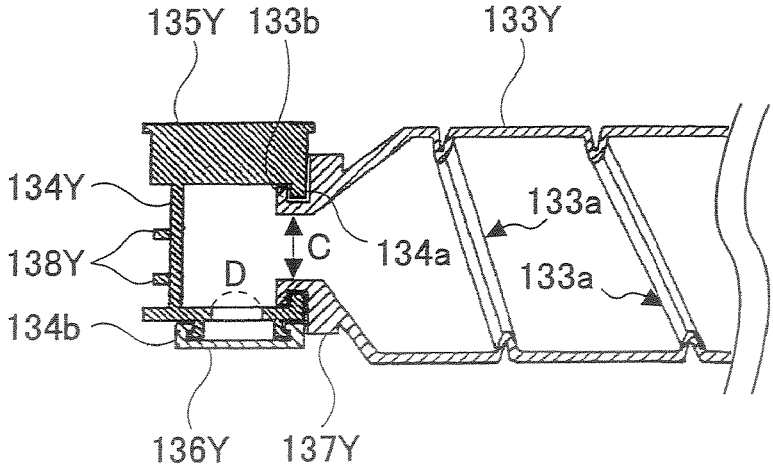
FIG. 15 is a cross-sectional view of the toner bottle of the present embodiment.

FIG. 15 is a cross-sectional view of the toner bottle 132Y in the present embodiment. In FIG. 15, the circumference of the cap portion 134Y of the toner bottle is shown in the cross section of the toner bottle 132Y taken along the central axis A of the toner bottle 132Y and passing through the toner outlet.

The engagement projection 133*b* is formed in the portion of the bottle main part 133Y which constitutes the opening C over the peripheral surface. On the other hand, the engagement projection 134*a* which fits into the recess between the engagement projection 133*b* and the bottle gear 137Y is provided in the cap portion 134Y.

And the opening C of the bottle main part 133Y is covered by the cap portion 134Y when the cap portion 134Y is attached to the bottle main part 133Y so that the engagement projection 134*a* of the cap portion 134Y may fit into the recess.

The cap portion 134Y is a hollow cylindrical component having a diameter slightly smaller than the diameter of the bottle main part 133Y, and the handle 135Y which is a displacement unit is integrally formed with the peripheral surface of the cap portion 134Y.

Moreover, the guide rail 134*b* which guides the relative displacement of the shutter 136Y to the cap portion 134Y in the rotating direction (the forward or reverse rotation is not called for) of the bottle main part 133Y is provided on the peripheral surface of the cap portion 134Y.

The shutter 136Y can be slid in the rotating direction of the bottle main part 133Y along with the peripheral surface of the cap portion 134Y, while it is guided by the guide rail 134*b*. In the state of FIG. 15, the shutter 136Y is set in the closed position where the toner outlet D which is provided on the peripheral surface of the cap portion 134Y is in the closed state.

In addition, if the shutter 136Y is opened when the operator deals with the toner bottle 132Y, the toner outlet D which is open to the opening C is opened and the Y toner falls.

Therefore, in the present embodiment, the shutter 136 is energized with the spring 144, which is an energization unit shown in FIG. 14, in the direction toward the closed position, so that the Y toner does not easily fall by the handling of the operator.

Next, a description will be given of the composition of the bottle holder of the toner supply device to which the respective toner bottles 132Y, 132C, 132M, and 132K are set.

Figure 16:
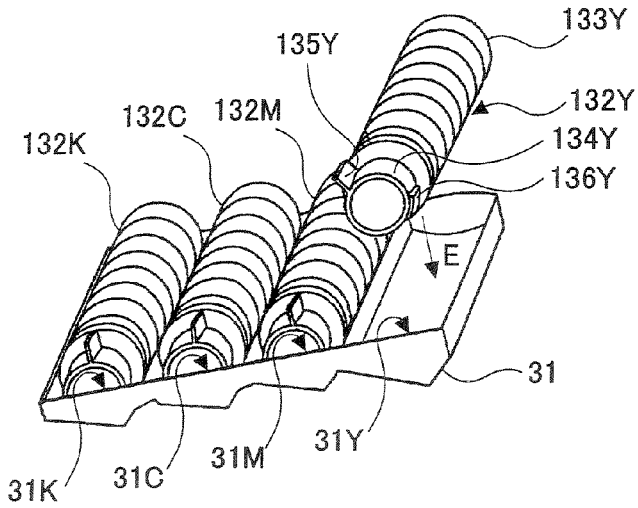
FIG. 16 is a perspective view of the bottle holder and the toner bottles in the present embodiment.

FIG. 16 is a perspective view of the bottle holder 31 of the toner supply device in the present embodiment.

The bottle holder 31, which is a container mounting unit, holds the four bottle holders 31Y, 31M, 31C, and 31K for attaching the four toner bottles 132Y, 132M, 132C, and 132K, respectively.

In FIG. 16, the intermediate state of the toner bottle 132Y being attached thereto among the four toner bottles 132Y, 132M, 132C and 132K is illustrated.

The operator puts the toner bottle 132Y on the bottle holder 31Y in the state where it is faced to the direction in which the handle 135Y of the cap portion inclined to the perpendicular direction, when setting the toner bottle 132Y to the bottle holder 31Y.

Then, it is possible to rotate the handle 135Y in the direction of clockwise rotation as shown, and the handle 135Y is turned to the upward perpendicular direction similar to the other toner bottles 132M, 132C and 132K as shown.

The cap unit 134Y also rotates in one with rotation of such handle 135Y. Although the bottle main part 133Y will also rotate together when it attaches with cap portion 134Y and bottle main part 133Y and condition is strong at this time, it does not matter even if bottle main part 133Y rotates together at this time and it does not carry out.

On the other hand, the shutter 136Y attached to the cap portion 134Y is stopped by the shutter stop unit (not shown) provided inside the bottle holder 31Y, and it is not rotated by the rotation of the cap portion 134Y.

If the operator manipulates the handle 135Y in the present embodiment, the toner outlet D of the cap portion 134Y is set in the opened state while it faces the inner bottom side (the downward perpendicular direction) of the bottle holder 31Y.

In addition, the toner bottles 132M, 132C, and 132K of other colors are also set by the same operation on each bottle holders 31M and 31C and 31K.

Next, a description will be given of the composition and operation for setting toner bottle 132Y to bottle holder 31Y.

Figure 17A:
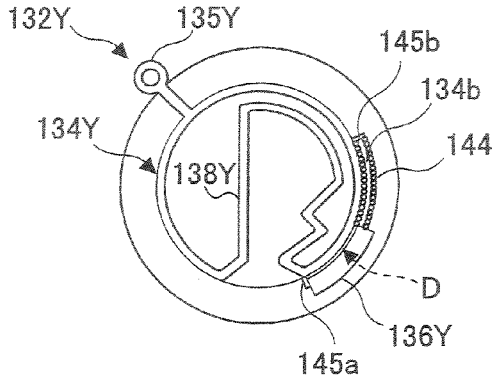
FIG. 17A and FIG. 17B are cross-sectional views of the toner bottle and the bottle holder before attachment of the bottle to the holder.
Figure 17B:
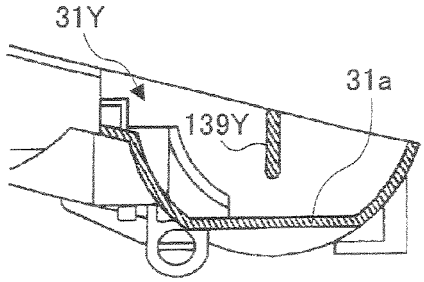
Figure 18:
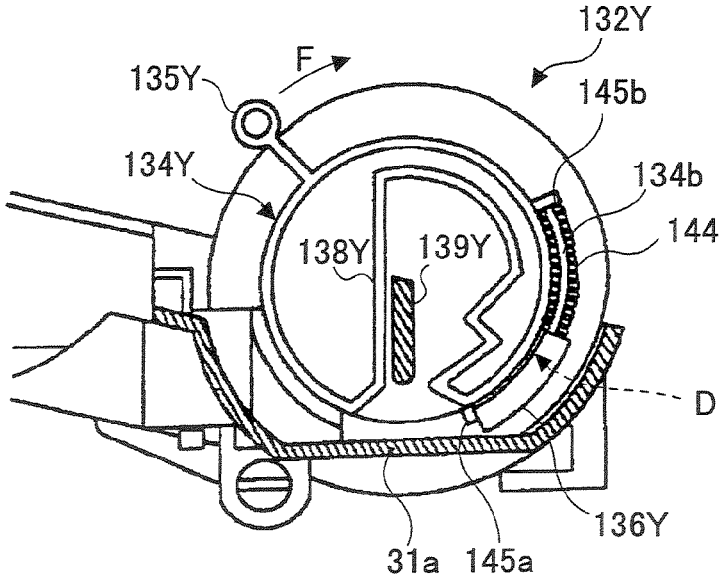
FIG. 18 is a cross-sectional view of the bottle holder to which the toner bottle is attached.
Figure 19:
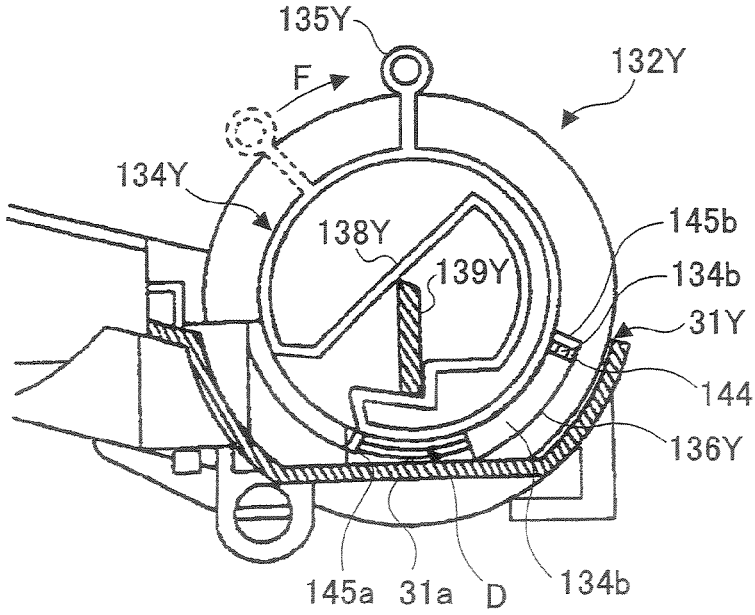
FIG. 19 is a cross-sectional view of the bottle holder with the toner bottle being rotated.

FIG. 17 through FIG. 19 are cross-sectional views of the bottle holder 31Y in the state where the front elevation when seeing toner bottle 132Y from the cap portion 134Y side and the wall of bottle holder 31Y on the side of cap portion 134Y is removed.

As shown, the engagement wall 138Y which curves in complicated form is provided in the end surface of cap portion 134Y. The toner bottle 132Y is in the condition in the direction in which the handle 135Y is inclined to the perpendicular direction, and is laid on the bottle holder 31Y from the direction of the arrow E in FIG. 18.

The condition is also the condition in which the break of engagement wall 138Y which curves in complicated form is turned to the perpendicular direction bottom.

In the engagement wall 138Y of the toner bottle 132Y laid with this condition, the engagement board 139Y of the bottle holder 31Y passes along the above-mentioned break, and it advances into the space surrounded by engagement wall 138Y (FIG. 18).

At this time, the toner bottle 132Y is still not in the normally set condition, and the toner outlet D (not shown) of the cap portion 134Y is in the closed state by the shutter 136Y.

In the state of FIG. 18, the operator takes the handle 135Y of the toner bottle 132Y laid on the bottle holder 31Y, and rotates it in the direction (clockwise rotation) of the arrow F in FIG. 18 so that the handle 135Y is turned to the downward perpendicular direction.

Then, the cap portion 134Y or the bottle main part 133Y is rotated in the direction of the arrow F in FIG. 18. Although the shutter 136Y provided in the cap portion 134Y also tends to be rotated in the direction of the arrow F in FIG. 18 with this rotation, the shutter 136Y contacts the shutter stop unit 31*a* of the bottle holder 31Y. Thereby, the rotation of the shutter 136Y is prevented, and the energization force of the spring 144, and carries out relative displacement to the counter-clockwise rotation in the view to cap portion 134Y.

And the perpendicular direction bottom will be turned to and exposed by shutter 136Y till then by the toner outlet D which suited the closed state.

Furthermore, by the rotation of the cap portion 134Y in the direction of the arrow F as shown in FIG. 19, the engagement wall 138Y of the cap portion 134Y is engaged with the engagement board 139Y of the bottle holder 31Y. Thereby, the setting of the toner bottle 132Y to the bottle holder 31Y is completed.

Figure 20A:
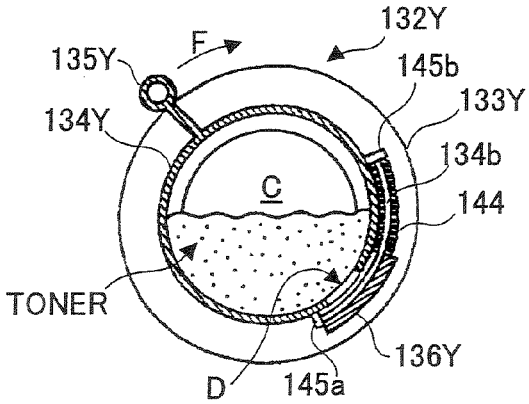
FIG. 20A is a cross-sectional view of the toner bottle before the bottle rotation.
Figure 20B:
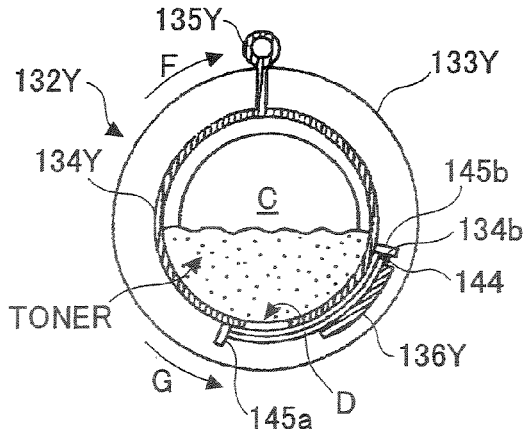
FIG. 20B is a cross-sectional view of the toner bottle after the bottle rotation.

FIG. 20A and FIG. 20B are cross-sectional views of the toner bottle 132Y taken in the transverse direction, which is perpendicularly to the central axis A, and passing through the toner outlet D. FIG. 20A shows the toner bottle 132Y of the condition shown in FIG. 18, and FIG. 20B shows the toner bottle 132Y of the condition shown in FIG. 19.

As shown in FIG. 20A and FIG. 20B, when the handle 135Y is rotated in the direction of the arrow F, the toner outlet D which is in the closed state by the shutter 136Y is opened, and it is located in the position to face in the downward perpendicular direction. Thus, under the toner outlet D facing in the downward perpendicular direction, the toner conveyance pipe (not shown) is arranged with its toner receiving opening facing in the upward perpendicular direction. Therefore, the Y toner discharged from the toner outlet D falls into the toner conveyance pipe by gravity.

Next, a description will be given of the composition and operation of the toner supply device.

Figure 21:
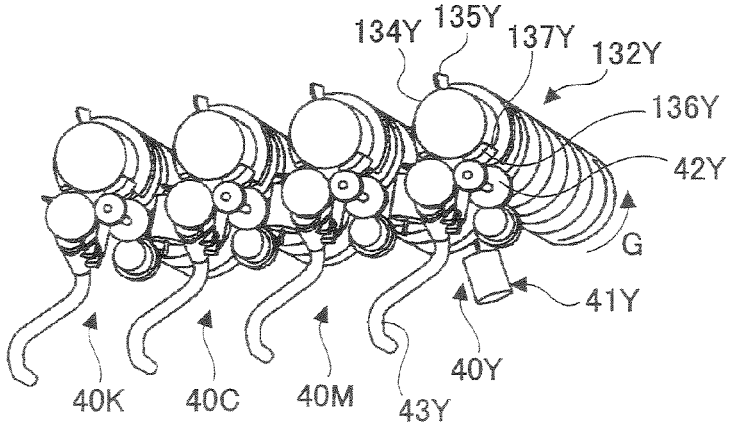
FIG. 21 is a perspective view of the Y, M, C and K toner supply devices in the present embodiment.

FIG. 21 is a perspective view of the Y, M, C, K toner supply devices 40Y, 40M, 40C, 40K in the printer 100.

The toner supply devices 40Y, 40M, 40C, 40K have the same composition except the colors of the toners of the there toner supply devices are different from each other. In the following, a description will be given of the Y toner supply device 40Y as a representative example of the four toner supply devices in the printer 100.

As shown in FIG. 21, the toner supply device 40Y is provided with the drive-motor 41Y, the drive gear 42Y, the toner conveyance pipe 43Y, etc. as in the first preferred embodiment described previously. Moreover, although illustration is omitted, the toner supply device 40Y is also provided with the bottle holder 31Y described above.

When the toner bottle 132Y is correctly set to the bottle holder 31Y as mentioned above, the drive gear 42Y is engaged with the bottle gear 137Y of the bottle main part 133Y. And when the drive gear 42Y is rotated by the drive-motor 41Y, the rotating force is transmitted to the bottle main part 133Y through the bottle gear 137Y, and the bottle main part 133Y is rotated in the direction of the arrow G in FIG. 21.

By the rotation, the Y toner accommodated inside the bottle main part 133Y is transferred to the opening A (the front side of FIG. 21), and enters the internal space of the cap portion 134Y. And the toner is discharged from the toner outlet D of the cap portion 134Y, and falls into the toner conveyance pipe 43Y.

In the toner conveyance pipe 43Y, the coil made of a resin which is not illustrated is installed inside as in the above-mentioned first preferred embodiment, and the rotation of the toner conveyance pipe 43Y is also carried out by the drive motor 41Y.

The Y toner received from the toner outlet D is conveyed along the inside wall of the toner conveyance pipe 43Y, and the coil made of the resin supplies the toner to the Y toner developing device (not shown) in the printer 100.

In the second preferred embodiment, as shown in FIG. 15, the cap portion 134 is attached to the bottle main part 133 by fitting the engagement projection 134*a* of the cap portion 134 into the recess between the engagement projection 133*b* of the bottle main part 133 and the bottle gear 137. When the rotation driving force of the drive motor 41Y is transmitted to the bottle main part 133Y, the bottle main part 133 is rotated in the direction of the arrow G shown in FIG. 20B or FIG. 21, while the frictional sliding arises between the cap portion 134 and the bottle main part 133.

When the toner bottle 132Y is set to the bottle holder 31Y, the cap portion 134Y is locked by a comparatively small force by the engagement of the engagement wall 138Y and the engagement board 139Y of the bottle holder 31Y.

Moreover, in the present embodiment, when the shutter 136Y has a relative displacement to the cap portion 134Y in the reverse direction to the direction (the direction of the arrow G in FIG. 20B) of the rotation of the bottle main part 133Y as shown in FIG. 20B, the shutter 136Y is provided so that the toner outlet D is in the closed state. Therefore, when the frictional force between the bottle main part 133Y and the cap portion 134Y exceeds the force to lock the cap portion 134Y, the cap portion 134Y is rotated with the rotation of the bottle main part 133Y.

Consequently, the toner outlet D which is in the opened state previously is in the closed state by the shutter 136Y. This causes the toner supply to be avoided, even when the toner supply device is driven to rotate the bottle main part 133Y.

Figure 22A:
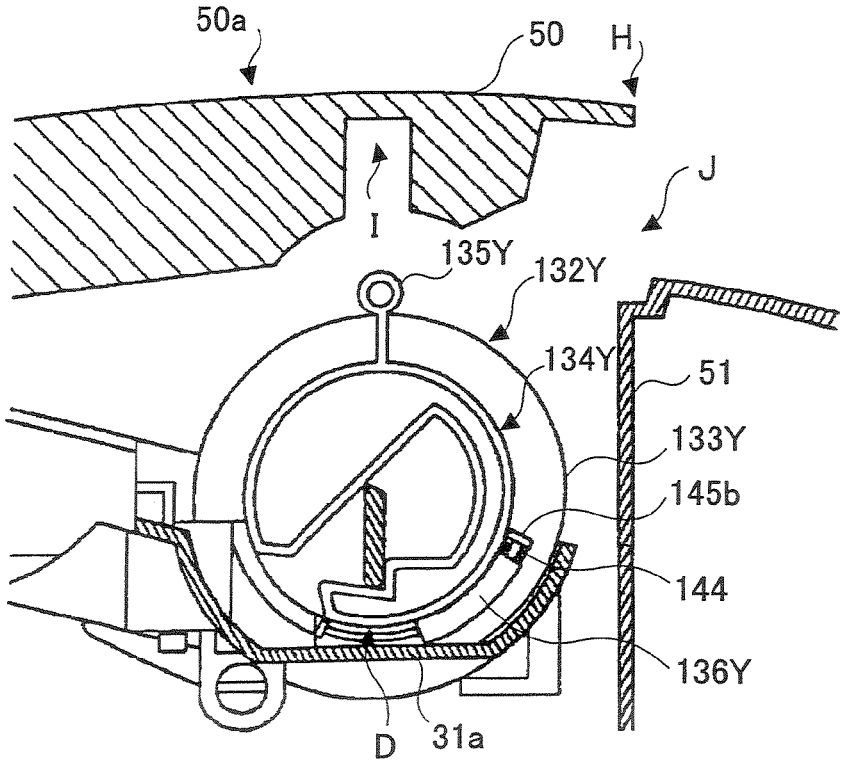
FIG. 22A is a cross-sectional view of the bottle holder before the open/close cover is closed.
Figure 22B:
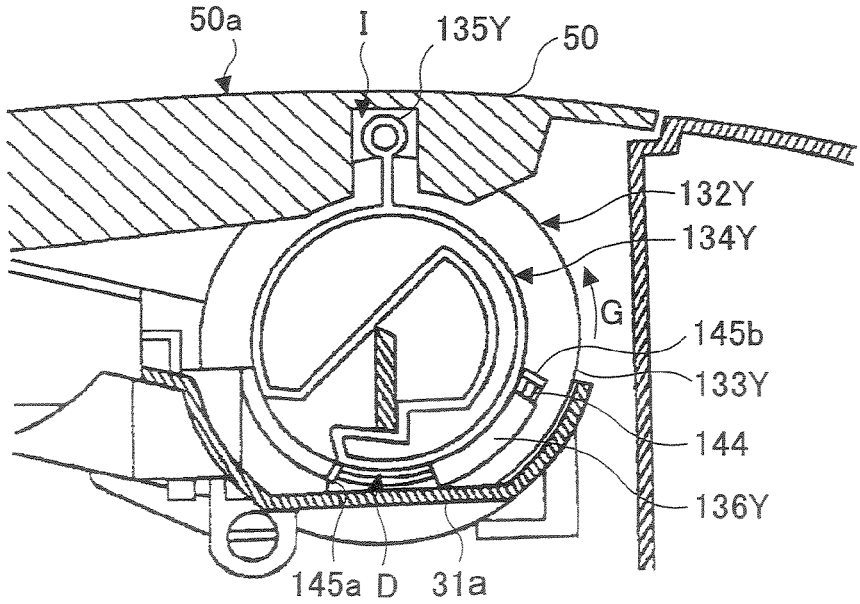
FIG. 22B is a cross-sectional view of the bottle holder after the open/close cover is closed.
Figure 23:
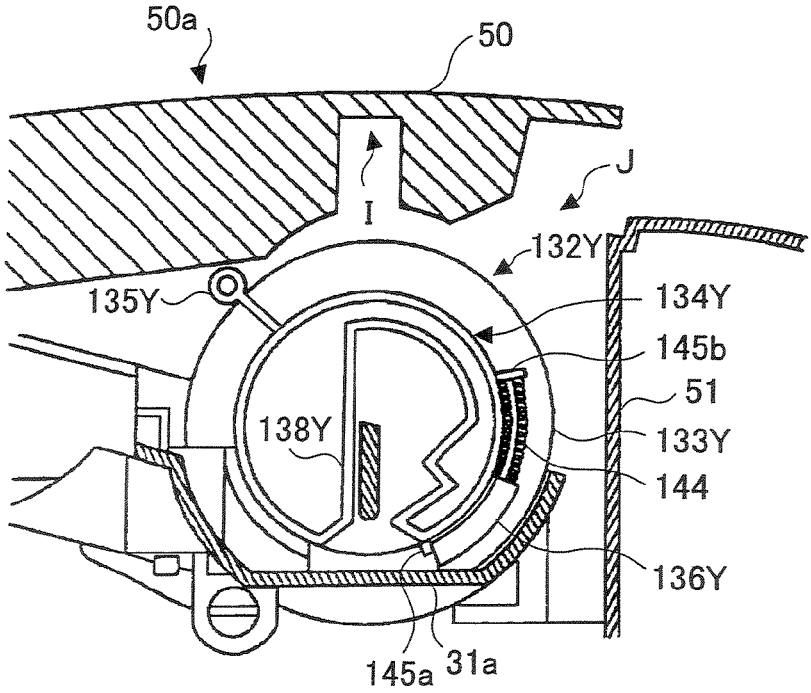
FIG. 23 is a cross-sectional view of the bottle holder when the open/close cover is closed with the toner bottle being set incorrectly.

FIG. 22A and FIG. 22B are cross-sectional views of the bottle holder 31Y before and after the open/close cover 50 is closed by the operator.

The stack section 50*a* is constituted by the upper surface of the open/close cover 50 provided in the upper part of the printer housing 51. The operator opens the open/close cover 50 so that the toner bottles 132Y, 132M, 132C, 132K on the bottle holder 31 are exposed, and performs the exchange work of the toner bottle.

The recess I, which accommodates the handle 135Y of the toner bottle 132Y inside when the open/close cover 50 is closed, is formed in the inside surface of the open/close cover 50. In addition, although only the upper portion of the Y toner bottle 132Y is shown in FIG. 22A and FIG. 22B, rather than the entire region of the open/close cover 50, the recess I for each of the toner bottles 132M, 132C and 132K of the other colors is formed in the inside surface of the open/close cover 50, respectively.

When the toner bottle 132Y is set to the bottle holder 31Y, the open/close cover 50 is moved in the direction of the arrow H in FIG. 22A, and the attachment/detachment opening J is closed, as shown in FIG. 22B. Then the handle 135Y enters into the recess I of the open/close cover 50, and the handle 135Y is fitted to the recess I.

As mentioned above, when the rotation driving force of the drive motor 41Y is transmitted to the bottle main part 133Y, if the force to lock the cap portion 134Y exceeds the frictional force between the bottle main part 133 and the cap portion 134, the cap portion 134Y tends to rotate with the rotation of the bottle main part 133Y.

However, the handle 135Y which is rotated integrally with the cap portion 134Y is regulated by the fitting of the open/close cover 50 to the recess I. That is, even if the handle 135Y tends to be rotated counterclockwise with the rotation of the cap portion 134Y, the handle 135Y cannot contact the left-hand side surface of the recess I of the open/close cover 50 (which is a regulation wall), and cannot displace any more. Thereby, it is possible to prevent also the rotation of the cap portion 134 that is rotated integrally with the handle 135Y.

Therefore, the shutter 136Y which is positioned in the state where it is pushed against the shutter stop unit 31*a* of the bottle holder 31Y with the spring 144 is not subjected to the relative displacement to the cap portion 134Y. Thus, the toner outlet D provided in the cap portion 134Y will not be in the closed state.

In addition, the same discussion is applied to the toner bottles 132M, 132C and 132K of the other color toners, not only the Y toner bottle 132Y.

In the above-described embodiment, the displacement which regulates displacing so that the shutter 136Y may carry out relative displacement to the direction which handle 135Y which has the composition that the recess I of the handle 135Y and the open/close cover 50 of cap portion 134Y fits in, in the opened position corresponding to the relative position of shutter 136Y where the toner outlet D will be in the opened state makes change the toner outlet D into the closed state—it comprises as a regulation unit.

It functions as a regulation unit to regulate carrying out relative displacement of the composition to the direction to which shutter 136Y changes the toner outlet D into the closed state to cap portion 134Y according to the friction with the bottle main part 133Y.

On the other hand, even if it is going to close the open/close cover 50 as shown in the view 23 when the operator has forgotten to rotate handle 135Y, it will be prevented that the handle 135 runs against the inside surface the open/close cover 50, and the open/close cover 50 closes.

Therefore, the operator can notice that see the situation which cannot close the open/close cover 50, and the set of toner bottle 132Y is not made appropriately.

In addition, the same discussion is applied also to the toner bottles 132M, 132C, and 132K of the other toner colors, not only to the Y toner bottle 132.

Next, a description will be given another embodiment of the toner supply device of the invention.

In the present embodiment, only the composition of the inside surface of the open/close cover 50 differs from that in the previous embodiment, but the other composition of the present embodiment is essentially the same as that of the previous embodiment, and a description thereof will be omitted.

Figure 24:
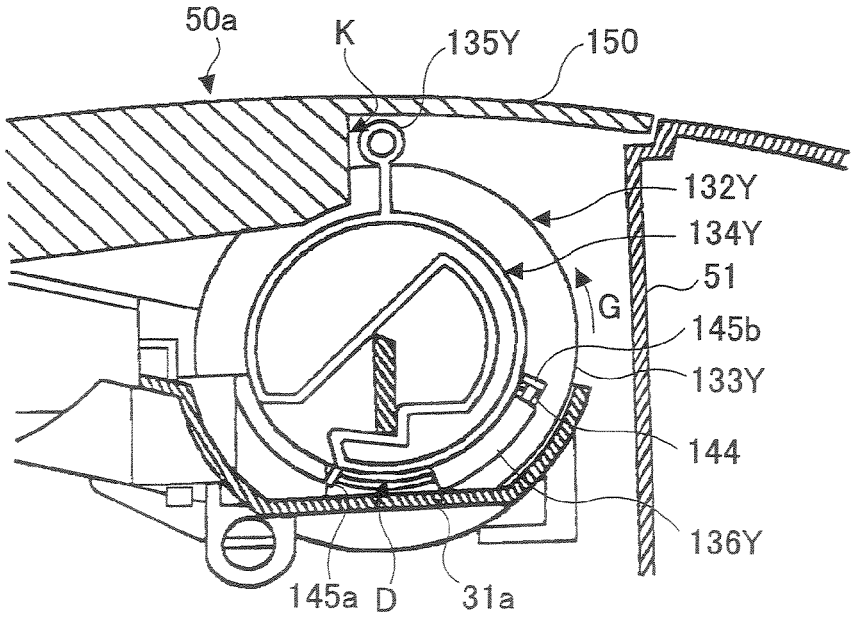
FIG. 24 is a cross-sectional view of another embodiment of the open/close cover and the bottle holder in the second preferred embodiment of the invention.

FIG. 24 is a cross-sectional view of the bottle holder 31Y in the state where the front elevation when seeing toner bottle 132Y from the cap portion 134Y side and the surface of a wall of bottle holder 31Y by the side of cap portion 134Y are removed, and the diagram illustrating sectional drawing of the open/close cover 150 of the printer 100.

When the open/close cover 150 is closed, the regulation wall K which is provided the inside surface the open/close cover 150 regulates that the handle 135Y of toner bottle 132Y rotates to the counterclockwise rotation in FIG. 24.

If the frictional force between bottle main part 133Y and cap portion 134Y exceeds the force to lock the cap portion 134Y when the bottle main part 133Y is rotated in the direction of the arrow G in FIG. 24 as mentioned above, the cap portion 134Y also tends to rotate in the direction of the arrow G in FIG. 24.

However, even if the handle 135Y which is rotated integrally with the cap portion 134Y by the rotation tends to displace to the counterclockwise rotation in FIG. 24, the handle 135Y cannot contact the regulation wall K of the open/close cover 50, and cannot be displaced any more.

Therefore, the handle 135Y and the cap portion 134 cannot be rotated integrally. Hence, the toner outlet D provided in the cap portion 134Y will not be in the closed state as in the above-mentioned embodiment.

In addition, the same discussion is also applicable to the other toner bottles 132M, 132C, 132K of other toner colors, not only the toner bottle 132Y.

Even if the cap portion 134Y tends to rotate for reverse with the direction of the arrow G and handle 135Y displaces in the present embodiment, there is no regulation wall which contacts in the displacement direction of the handle 135Y. However, the cap portion 134Y does not receive the torque in the direction according to the friction with rotating bottle main part 133Y.

And since stopper 134*c* is provided in guide rail 134*b* which guides shutter 136Y, shutter 136Y does not carry out relative displacement more than stopper 134*c* to cap portion 134Y. Therefore, even if it does not regulate the displacement of the direction of the clockwise rotation of handle 135Y, it is satisfactory in any way.

The possibility that handle 135Y which is in the suitable opened position by having removed the portion which regulates the displacement of the direction of the clockwise rotation of handle 135Y as in the above-mentioned embodiment may be caught in the angle of recess I will decrease.

Therefore, the handle 135Y in the suitable opened position stops easily being able to cause trouble to opening-and-closing operation of the open/close cover 150.

In addition, although the above explanation explained only toner bottle 132Y for Y, the same is said of the toner bottles 132M, 132C, and 132K of other colors.

Next, a description will be given of another example of the toner supplying device of the invention.

In addition, except that the form of the recess in the inside surface the open/close cover 50 differs, the present embodiment is essentially the same as the previously described embodiment, and a description about the same elements as in the previously described embodiment will be omitted.

FIG. 25 is a cross-sectional view of the bottle holder 31Y in the state where the front elevation when seeing toner bottle 132Y from the cap portion 134Y side and the surface of a wall of bottle holder 31Y by the side of cap portion 134Y are removed, and the diagram illustrating sectional drawing of the open/close cover 250 of the printer 100.

Although the recess I in the present embodiment is formed in the inside surface the open/close cover 250 similar to the previous embodiment, the guiding side M, which is a guiding unit, is formed in the entrance portion of the recess I.

Figure 25A:
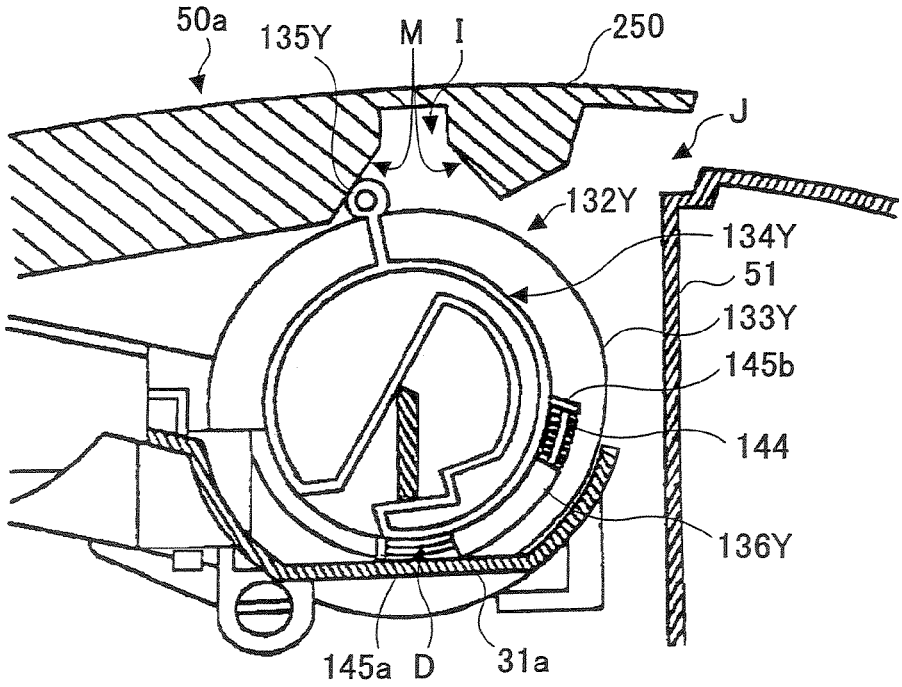
FIG. 25A is a cross-sectional view of the bottle holder before another embodiment of the open/close cover is closed.

During the operation which closes the open/close cover 250, the guiding side M contacts the handle 135 of the toner bottle 132Y from which toner outlet D is not in opened state completely and which is set imperfectly Y, as shown in FIG. 25A. And when closing the open/close cover 250 further, the handle 135Y is slid along the guiding side M, and fitted into the recess I.

Figure 25B:
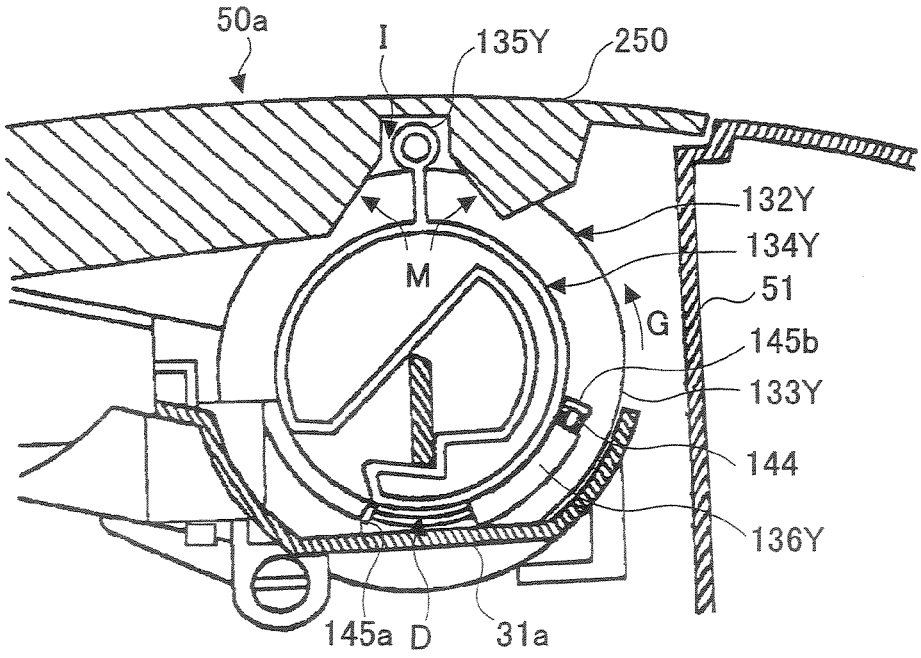
FIG. 25B is a cross-sectional view of the bottle holder after the open/close cover of this embodiment is closed.

Thereby, the handle 135Y comes to turn to the perpendicular direction upper part, as shown in FIG. 25B, the toner bottle 132Y is set appropriately, and the toner outlet D will be in the opened state completely.

Thus, in the present embodiment, the toner outlet D will not be in the opened state completely, but even if the setting of toner bottle 132Y is imperfect, operation which the open/close cover 250 closes sets appropriately so that the toner outlet D may be in the opened state completely automatically.

In addition, the same discussion is also applicable to the toner bottles 132M, 132C, 132K of the other toner colors, not only the Y toner bottle 132Y.

Next, a description will be given of another example of the toner supplying device of the invention.

Figure 26A:
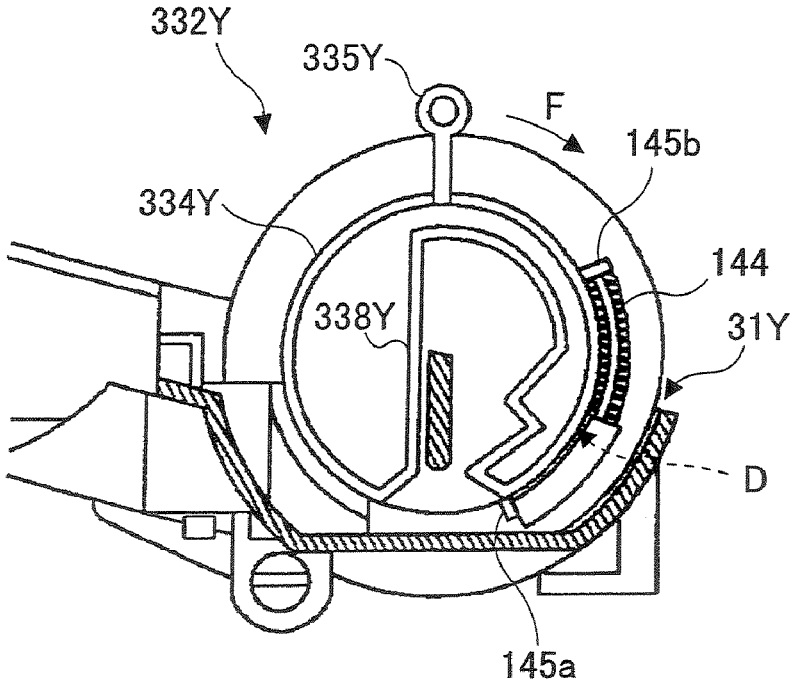
FIG. 26A is a cross-sectional view of another embodiment of the toner bottle and the bottle holder after the toner bottle is attached to the bottle holder.
Figure 26B:
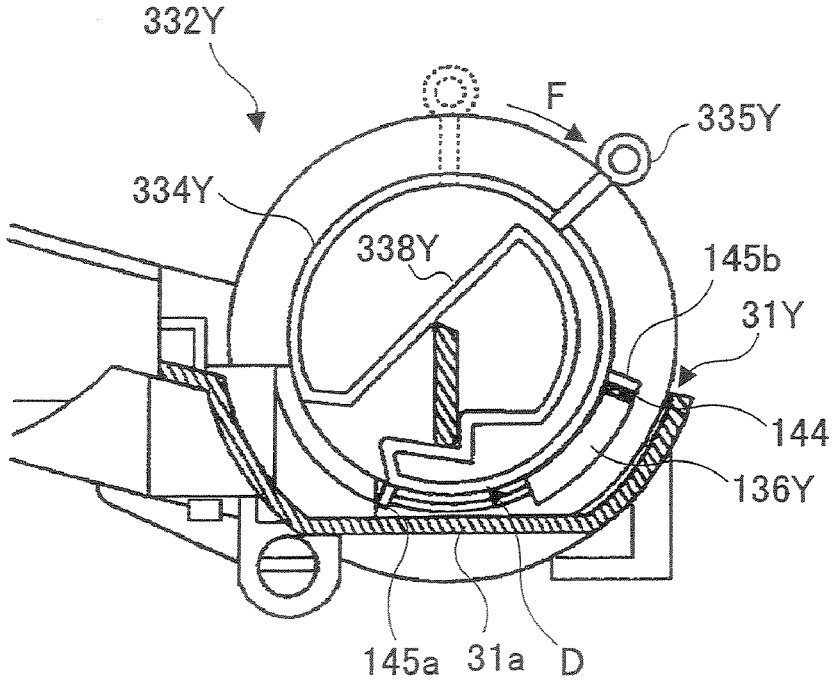
FIG. 26B is a cross-sectional view of the bottle holder with the toner bottle being rotated.

FIG. 26A and FIG. 26B are cross-sectional views of the toner bottle 332Y and the bottle holder 31Y in the present embodiment.

In the present embodiment, the toner bottle 332Y is in the condition in which the handle 335Y is turned to the upward perpendicular direction, and as shown in FIG. 26A, it is laid on the bottle holder 31Y.

And the operator takes the handle 335Y of the toner bottle 332Y laid on the bottle holder 31Y, and rotates it in the direction (clockwise rotation) of the arrow F in FIG. 26A so that it faces to the direction toward which the handle 335Y is inclined by about 45 degrees to the perpendicular direction.

Then, as in the previously described embodiment, when the cap portion 334Y is rotated in the direction of the arrow F in the view, the shutter 336Y is stopped by the shutter stop unit 31*a* of the inside of bottle holder 31Y.

Thereby, as shown in FIG. 26B, the toner outlet D of cap portion 334Y will be in the opened state while facing the inner bottom side (the downward perpendicular direction) of the bottle holder 31Y.

Figure 27:
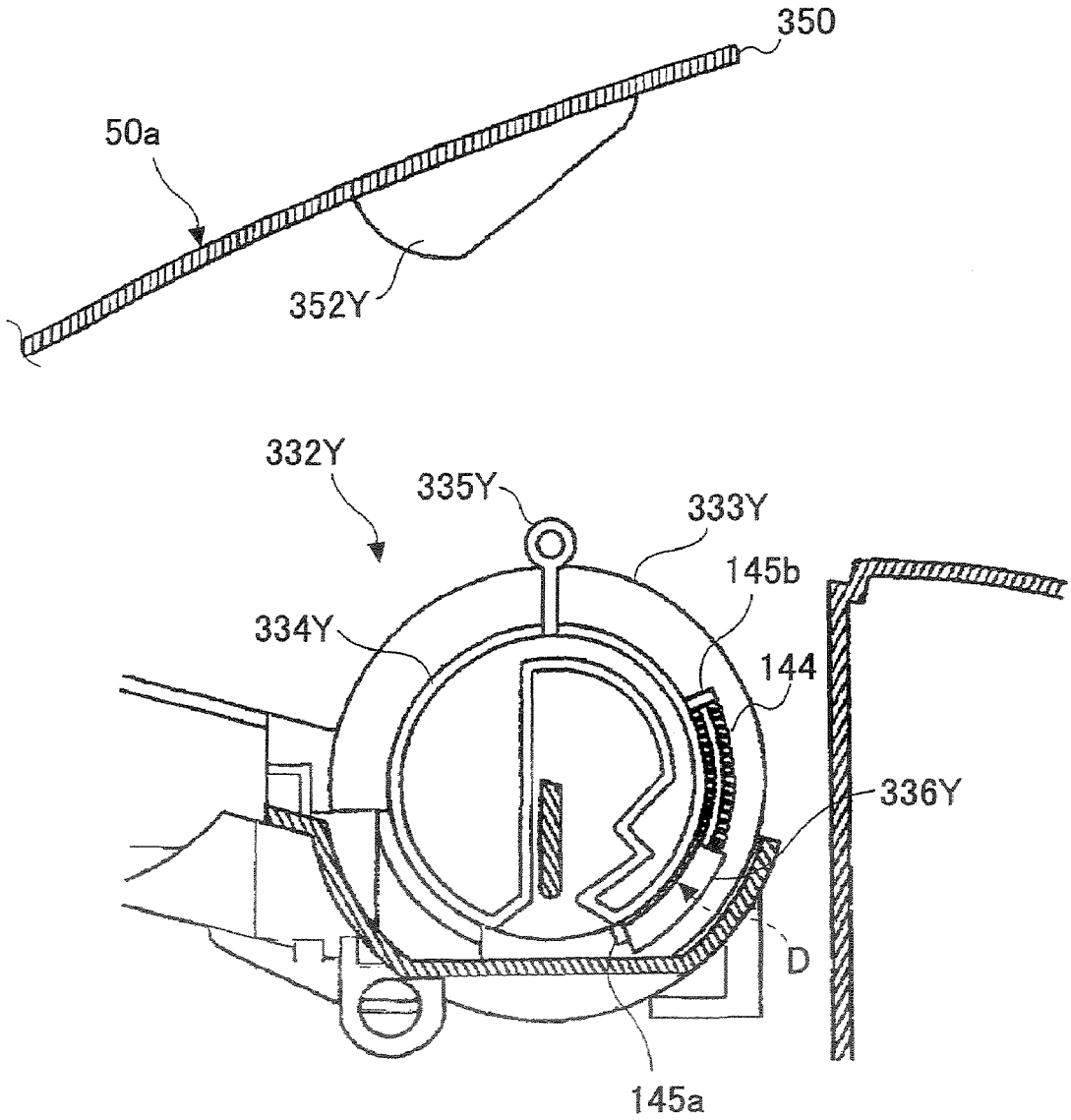
FIG. 27 is a cross-sectional view of another embodiment of the open/close cover and the bottle holder with the toner bottle being set incorrectly.

FIG. 27 is a cross-sectional view of the bottle holder 31Y in the state where the front elevation when seeing toner bottle 332Y from the cap portion 334Y side and the surface of a wall of bottle holder 31Y by the side of cap portion 334Y are removed, and the diagram illustrating sectional drawing of the open/close cover 350 of the printer 100.

The guiding projection 352Y which projects towards the handle 335Y of the toner bottle 332Y is provided in the undersurface of the open/close cover 350 in the present embodiment.

Although only the upper part of the Y toner bottle 332Y is shown among the entire region of the open/close cover 350, the open/close cover 350 is also provided with the guiding projection corresponding to the toner bottles of the other colors, respectively.

The guiding projection 352Y is in the form which has a cam-like roundness. In the present embodiment, if the toner bottle 332Y is laid on the bottle holder 31Y, the handle 335Y of the cap portion 334Y will be turned to the upward perpendicular direction.

If the operator does not rotate the handle 335Y in the clockwise rotating direction as mentioned above, the open/close cover 350 has been accidentally closed although the toner outlet D is in the closed state by the shutter 336Y.

Figure 28A:
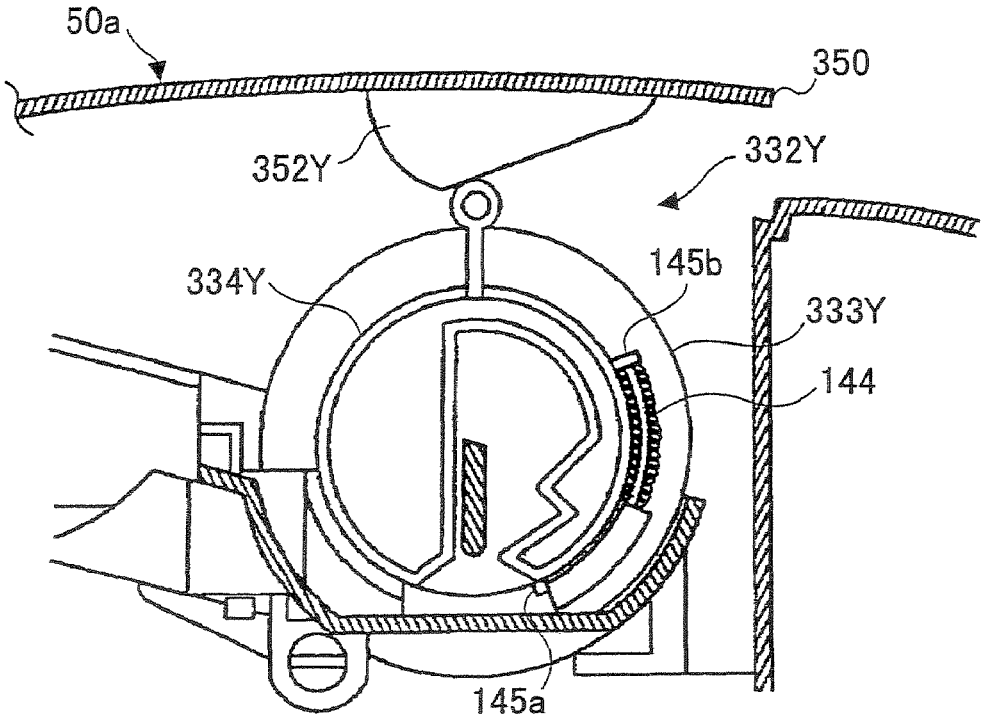
FIG. 28A and FIG. 28B are cross-sectional views of the open/close cover and the bottle holder before and after the open/close cover is closed.

Then, as shown in FIG. 28A, the guiding projection 352Y of the open/close cover 350 contacts the handle 335Y, which will turn the handle 335Y to the perpendicular direction.

And in connection with the open/close cover 350 being closed further, the handle 335Y will be slid along with the guiding-projection 352Y, and will rotate about 45 degrees clockwise.

Figure 28B:
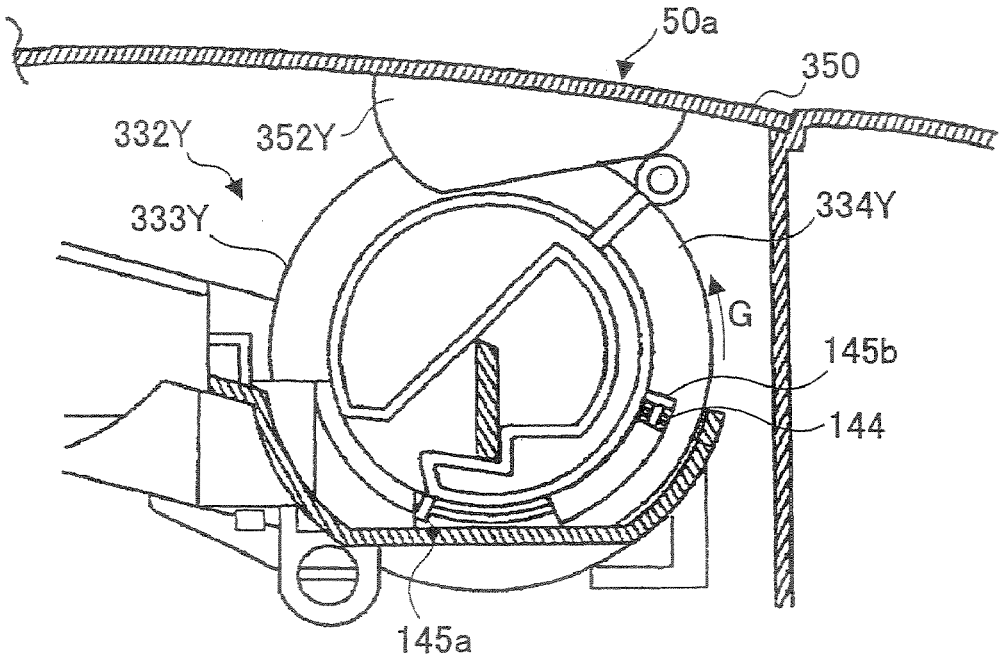

Thereby, the handle 335Y is set in the condition that it faces to the direction in which it is inclined by about 45 degrees to the upward perpendicular direction as shown in FIG. 28B, and the toner bottle 332Y is set appropriately and the toner outlet D will be in the opened state.

Thus, in the present embodiment, the guiding projection 352Y functions as a guiding unit, and the toner outlet D will not be in the opened state, and even if the setting of the toner bottle is imperfect, the closing of the open/close cover 350 is set appropriately so that the toner outlet D may be in the opened state completely automatically.

Furthermore, if the open/close cover 350 is closed completely, as shown in FIG. 28B, even if the handle 335Y tends to displace in the direction of the counterclockwise rotation in the view, since it is pushed into guiding-projection 352Y of the open/close cover 350, handle 335Y cannot be displaced.

That is, even if the handle 335Y tends to displace the toner outlet D to the direction which it is going to change into the opened state, it functions as a displacement regulation unit by which the open/close cover 350 and its guiding-projection 352Y are regulation units, and the displacement is regulated.

Therefore, as mentioned above, even if cap portion 334Y also tends to rotate to the direction of the arrow C in the view according to the friction with bottle main part 333Y which rotates to the direction of the arrow G in the view, the toner outlet D will not be in the closed state.

In addition, the same discussion is also applicable to the M, C, K toner bottles of the other toner colors in the printer, not only the Y toner bottle.

Next, a description will be given of another example of the toner supplying device of the invention.

Figure 29A:
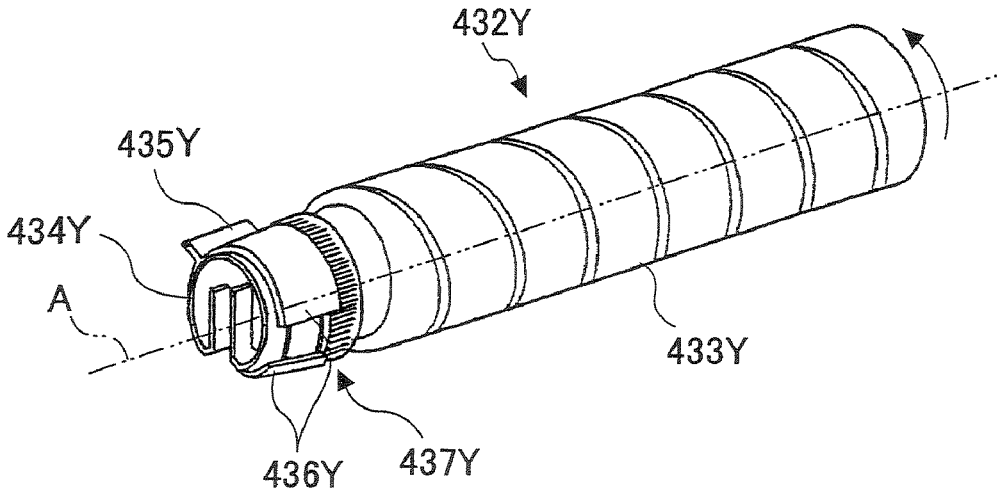
FIG. 29A is a perspective view of another embodiment of the toner bottle in the second preferred embodiment of the invention.
Figure 29B:
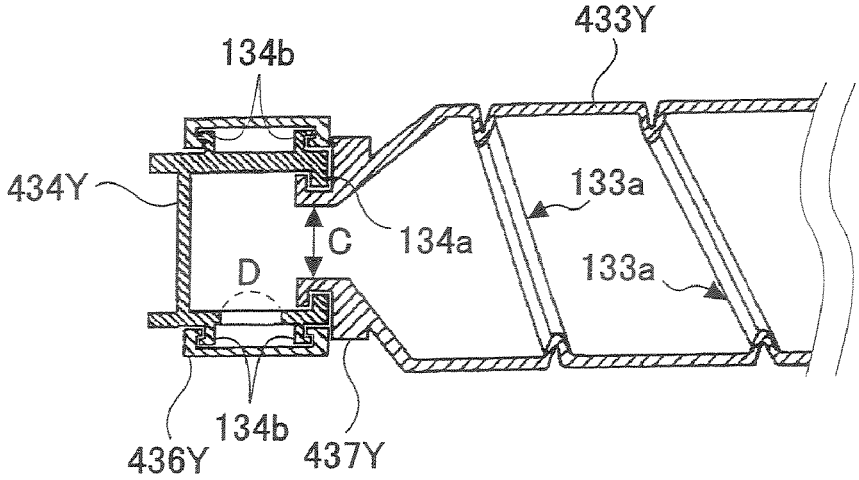
FIG. 29B is a cross-sectional view of the toner bottle of the present embodiment.

FIG. 29A is a perspective view of the toner bottle 432Y in the present embodiment. FIG. 29B is a cross-sectional view of the circumference of the cap portion 434Y taken along the central axis A of the toner bottle 432Y and passing through the toner outlet D.

Although the toner bottle 432Y in the present embodiment is essentially the same as in the previously described embodiments with respect to the composition of the bottle main part 433Y, but the composition of the cap portion 434Y differs.

In the present embodiment, except for the opening for discharging the Y toner from the toner outlet D, the shutter 436Y is provided so as to cover the peripheral surface of cap portion 434Y. And the handle 435Y which is taken by the operator is attached to the shutter 436Y.

Moreover, the engagement wall 438Y, which engages with the engagement board 139Y of the bottle holder 31Y, is provided in the end surface of the cap portion 434Y such that the engagement board 139Y is surrounded by the engagement wall 438Y.

Figure 30A:
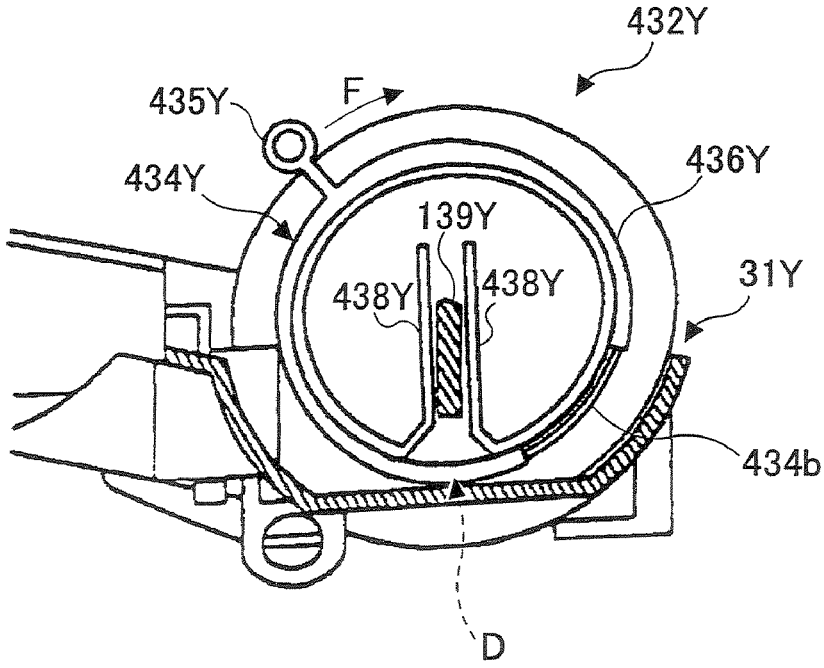
FIG. 30A is a cross-sectional view of the bottle holder to which the toner bottle is attached.
Figure 30B:
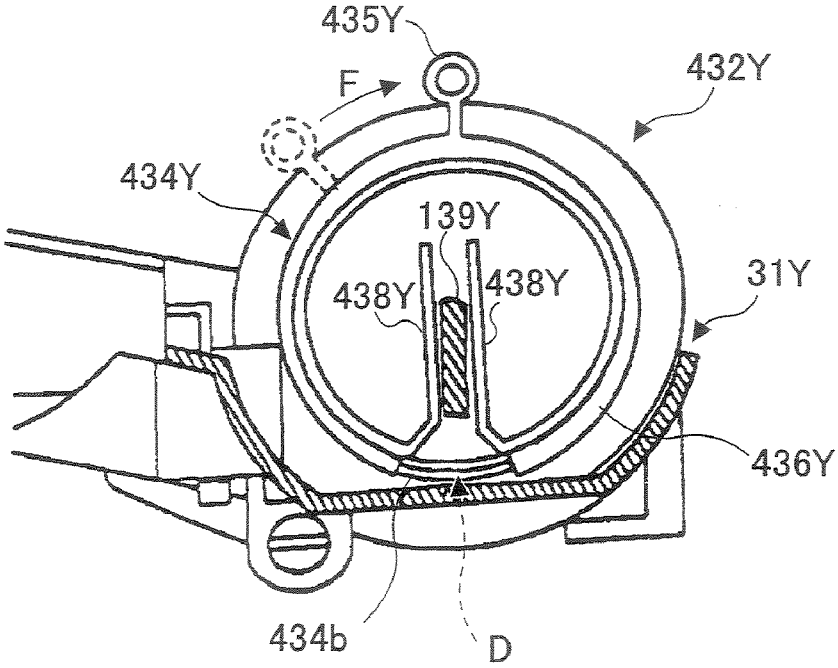
FIG. 30B is a cross-sectional view of the bottle holder with the toner bottle being rotated.

FIG. 30A and FIG. 30B are front and cross-sectional views of the bottle holder 31Y in the present embodiment when seeing the toner bottle 432Y from the cap portion 434Y side and the wall portion of the bottle holder 31Y on the side of the cap portion 434Y is removed.

The toner bottle 432Y is laid on the bottle holder 31Y in the condition in which the handle 435Y is inclined in a suitable direction to the perpendicular direction as shown in FIG. 30A. This condition is also the condition in which the break of the engagement wall 438Y formed integrally with the cap portion 434Y is turned to face to the downward perpendicular direction.

At this time, the toner outlet D formed in the cap portion 434Y is closed by the shutter 436Y, where the outlet D faces to the downward perpendicular direction.

In the engagement wall 438Y of the toner bottle 432Y laid with such condition, the engagement board 139Y of the bottle holder 31Y passes along the above-mentioned break, and it advances in between for two engagement walls which becomes parallel mutually and counter.

The operator takes the handle 435Y of the toner bottle 432Y laid on bottle holder 31Y, and rotates it in the direction (clockwise rotation) of the arrow F in FIG. 30B so that the handle 435Y may turn to the upward perpendicular direction. Then, the shutter 436Y also rotates to the direction of the arrow F in FIG. 30B.

Although the cap portion 434Y also tends to rotate to the direction of the arrow F in FIG. 30B by this rotation, the rotation of the cap portion 434Y is prevented by the engagement of the engagement wall 438Y and the engagement board 139Y.

Therefore, relative displacement of the shutter 436Y is carried out to the clockwise rotation to cap portion 434Y. And as the toner outlet D which is in the closed state is opened to the opening between the shutter 436Y and it is shown in FIG. 30B by the shutter 436Y till then, the toner outlet D will be exposed. Thereby, the setting of the bottle holder 31Y of the toner bottle 432Y is completed.

Figure 31:
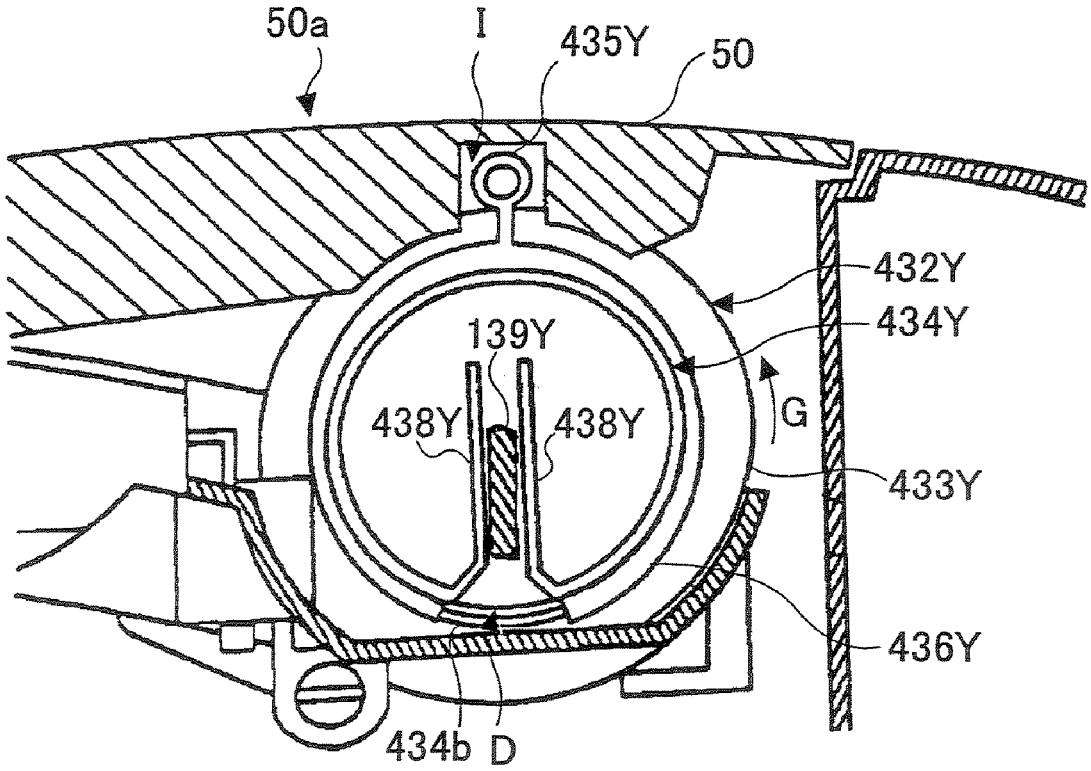
FIG. 31 is a cross-sectional view of the bottle holder after the open/close cover is closed.
Figure 32A:
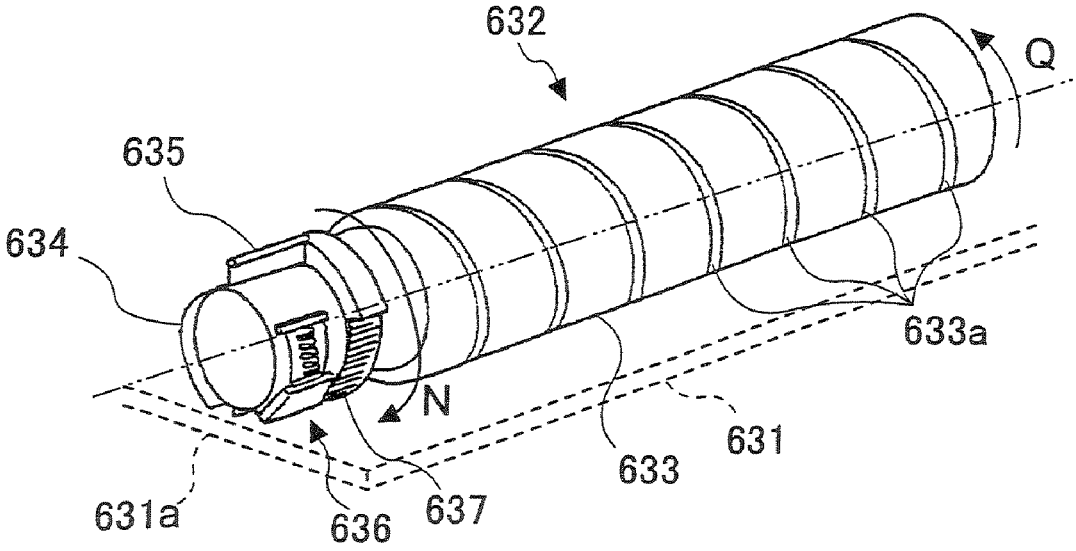
FIG. 32A is a perspective view of a conventional toner bottle.
Figure 32B:
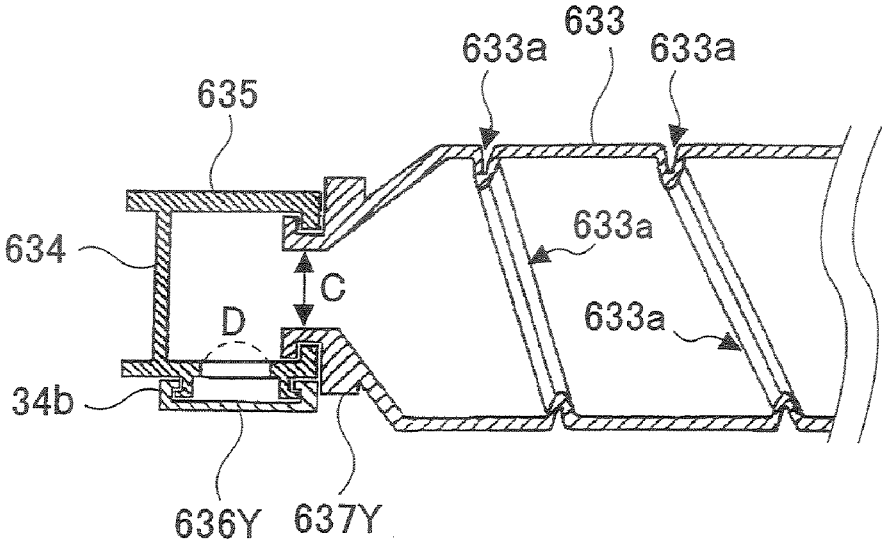
FIG. 32B is a cross-sectional view of a cap portion of the conventional toner bottle.

FIG. 31 is a cross-sectional view of the bottle holder 31Y after the open/close cover 50 of the printer 100 is closed when seeing the toner bottle 432Y from the cap portion 434Y side and the wall portion of bottle holder 31Y on the side of the cap portion 434Y is removed.

In addition, the composition of the open/close cover 50 is the same as that of the previously described embodiment.

In the present embodiment, the bottle main part 433Y will rotate, similar to the previously described embodiment, with the friction sliding with the cap portion 434Y, if the rotation driving force from the drive motor is transmitted.

In the present embodiment, by the engagement board 139Y being caught by the cap portion 434Y between the engagement wall 438Y, the rotation is impossible, and the cap portion 434Y does not rotate according to the friction with the bottle main part 433Y.

However, in the present embodiment, when the bottle main part 433Y rotates, the side surface of bottle gear 437Y and shutter 435Y which are formed integrally with the bottle main part 433Y will be subjected to the friction sliding.

Moreover, in the present embodiment, if the shutter 436Y carries out relative displacement in the same direction as the direction (the direction of the arrow G in FIG. 31) of rotation of the bottle main part 433Y to the cap portion 434Y as shown in FIG. 31, the toner outlet D will be in the closed state. Therefore, the shutter 435Y may rotate with the rotation of the bottle main part 433Y, and there is the possibility that the toner outlet D which is in the opened state may be closed by the shutter 436Y.

Therefore, if the toner bottle 432Y is set to the bottle holder 31Y and the open/close cover 50 is closed, the handle 435Y enters the recess I of the open/close cover 50 and it is fitted to the recess I in the present embodiment.

Hence, even if the shutter 435Y tends to displace to the counterclockwise rotation with the rotation of the bottle main part 433Y, the handle 435Y integrally formed with the shutter 435Y cannot contact the wall surface of the recess I of the open/close cover 50 (regulation wall) on the left-hand side in FIG. 31, and cannot displace any more. Therefore, the toner outlet D of the cap portion 434Y will not be in the closed state.

In addition, the same discussion is also applicable to the other toner bottles of the other toner colors, not only the Y toner bottle 432Y.

As mentioned above, the printer of the present embodiment is provided with the process cartridge 6, the exposure device 7 and the photoconductor 1 which is the image supporting medium as a visible image formation unit to form the toner image which is the visible image.

Moreover, the toner supply device 40 as a developer supplying device which has the toner bottle 132,332,432 as a developer container which equipped the printer with the main part 133,333,433 of the bottle which is the long picture main part of the container which accommodates the toner as a developer inside, and has the opening C in the direction end side of the length is formed (about the classication-by-color code, it omits also by the following explanation).

The cap portion 134,334,434 as the rotation unit which has the toner outlet D as an outlet which is open to the opening C on the side surface (peripheral surface) of the direction which is attached in the toner bottle to the main part 133,333,433 of the bottle so that the above-mentioned opening C may be covered, and intersects perpendicularly with it to the direction of the length is formed.

The toner supply device 40 is rotating the main part 133, 333,433 of the bottle of the toner bottle attached to the bottle holder 31 which is the container mounting unit so that the central axis A prolonged in the direction of the length may turn into the center-of-rotation axis, it moves the toner in the main part of the bottle to the opening C, is discharged through the toner outlet D of the cap portion 134,334,434, and supplies this to the developing device 5 which is the candidate for developer supply.

The shutter 136,336,436 which opens and closes the toner outlet D is formed in the printer by carrying out relative displacement along the rotating direction of the main part 133,333,433 of the bottle to the cap portion 134,334,434.

Moreover, the bottle main part 133,333,433 is configured so that it is rotated while applying the frictional force to which the cap portion 134,334,434 and the shutter 136,336,436 carry out relative displacement of the toner outlet D to the direction made into the closed state to the cap portion or the shutter.

Therefore, with the rotation of the bottle main part 133, 333,433, the cap portion 134,334 rotates in the previously described embodiments or the shutter 436 rotates in the present embodiment, and there is the possibility that the toner outlet D which is in the opened state may be closed by the shutter 136,336,436.

In the printer of the present embodiment, in order to discharge the toner in the main part of the bottle from the toner outlet D smoothly while rotating the main part 133,333,433 of the bottle, a regulation unit to regulate that the cap portion 134,334,434 and the shutter 136,336,436 carry out relative displacement of the toner outlet D to the direction changed into the closed state according to the friction with the main part of the bottle is provided.

Some examples of the regulation unit have been described above with the previous embodiments. It can prevent that the toner outlet D will be in the closed state with the rotation of the main part of the bottle, without changing the composition, even if it has composition rotated while it has the shutter 136,336,436 which carries out relative displacement to the cap portion 134,334,434 and the main part 133,333,433 of the bottle carries out friction sliding to the cap portion or the shutter by such composition as mentioned above.

Especially, in the previously described embodiments, when the toner bottle 132,332 is attached to the bottle holder 31, the shutter stop unit 31*a*, which is a rotation prevention unit to prevent the shutter 136,336 from rotating in the rotating direction of the main part 133,333 of the bottle, is provided. And it is made to carry out relative displacement of the cap portion and the shutter 136,336, and opens or closes the toner outlet D by rotating the cap portion 134,334 in the rotating direction of the main part 133,333 of the bottle.

In the above-mentioned composition, when the main part 133,333 of the bottle rotates, the cap portion 134,334 also rotates with frictional force with this, and there is the possibility that the toner outlet D may be in the closed state. However, by using the regulation unit mentioned above, even if the main part 133,333 of the bottle rotates, the cap portion 134,334 does not rotate. Therefore, the toner outlet D will not be in the closed state during the toner supply.

Moreover, in the above-mentioned embodiment, when the toner bottle 432 is attached to the bottle holder 31, engagement board 139Y as a rotation prevention unit and engagement wall 438Y which prevent that the cap portion 434 rotates along the rotating direction of the main part 433 of the bottle are provided.

And it has composition which is made to carry out relative displacement of the shutter and the cap portion 434, and the toner outlet D is opened and closed by rotating the shutter 436 along the rotating direction of the main part 433 of the toner bottle.

In the above composition, when the main part 433 of the bottle rotates, the shutter 436 is also rotated with frictional force with this, and there is a possibility that the toner outlet D may be in the closed state.

However, by the regulation unit in the above-mentioned embodiment, even if the main part 433 of the bottle rotates, the shutter 436 is not rotated. Therefore, the toner outlet D will not be in the closed state during the toner supply.

Moreover, in the above-mentioned embodiments, the developer supplying device is provided to be interlocked with the displacement of the handle 135,335,435, which is a displacement member, and the relative movement of the cap portion 134,334,434 and the shutter 136,336,436 is performed.

By providing the handle 135,335,435, the operator can open and close the toner outlet by easy operation. And the displacement regulation unit is used, in the above-mentioned embodiments, which regulates the displacement of the handle 135,335,435 which is in the opened position corresponding to the relative position of the cap portion 134,334,434 and the shutter 136,336,436 from which the toner outlet D will be in the opened state, so that relative displacement of the cap portion and the shutter to the direction which changes the toner outlet D into the closed state is avoided by the displacement regulation unit.

In addition, in the above-mentioned embodiments, the regulation wall K, the recess I, and the guiding projection 352 are used as the displacement regulation unit respectively.

Moreover, in the above-mentioned embodiments, the visible image formation unit and the toner supply device are configured in the housing 51. And the housing 51 has the open/close cover 50,150,250,350 as the cover component which opens and closes the attachment/detachment opening J which is provided for attaching the toner bottle 132,332,432 to and detaching the same from the bottle holder 31.

And in the above-mentioned embodiments, the displacement of the knob is regulated because the handle 135,335,435 in the opened position contacts the regulation wall formed in the inside surface the open/close cover 50,150,250,350 in the closed state.

The regulation wall is the inner wall of the recess I, the regulation wall K, or the guiding projection 352 in the above-mentioned embodiments. According to such composition, when the toner bottle is exchanged, the operator always performs the opening operation of the open/close cover 50,150, 250,350, and in accordance with this operation, it is possible to prevent the toner outlet D from being in the closed state with the rotation of the main part of the bottle.

Therefore, without adding new work to the exchange work of the toner bottle, it is possible to prevent the toner outlet D from being in the closed state with the rotation of the main part of the bottle, and the work burden is not applied to the operator.

It considers as the composition positioned in the position where the handle projects toward the attachment/detachment opening J when the handle 135 is in the opened position similar to the previously described embodiment especially.

Only by adding the composition into which recess I formed in the inside surface the open/close cover by the open/close cover 50 being closed and the handle 135 in the opened position fit, then the easy composition of preparing the recess in the inside surface the open/close cover 50. It is possible to prevent the occurrence of the toner outlet D being in the closed state by the rotation of the main part of the toner bottle.

Moreover, as in the above-mentioned embodiments, the guiding unit is provided to guide the handle to the opened position during operation which closes the open/close cover 250,350 to the housing 51 while the inside surface of the open/close cover contacts the handle 135 which is not in the opened position.

Even if the toner bottle 132 is not set appropriately and the toner outlet D is not in the opened state completely, the toner bottle 132 is automatically set appropriately by the closing operation of the open/close cover 50 which is usually performed by the operator.

Therefore, even if the toner bottle 132 is not set appropriately, the toner bottle 132 is appropriately set by the operator who closes the open/close cover 50, and the operator's convenience will improve.

Moreover, the toner bottle 132,332,432 of the present embodiment has the cap portion 134,334,434 which is the rotation unit which can rotate relative to the main part of the toner bottle. The cap portion is provided with the outlet D through which the toner inside the toner bottle is discharged, and with the shutter 136,336,436 which opens or closes the outlet D by rotation of the cap portion when the toner bottle is attached to the main part of the printer.

And the handle 135,335,435 as the engagement unit which engages with the main part of the printer and prevents rotation of the cap portion is formed in the circumferential direction side section of the cap portion 134,334,434.

Thereby, when the toner bottle 132,332,432 is set to the main part of the printer, the cap portion 134,334,434 does not rotate. Therefore, it is possible to prevent that the cap portion is rotated inappropriately in the wrong direction or the shutter 136,336,436 falls out at the time of the setting. Especially the toner bottle 132,332,432 of the present embodiment is provided so that it is detached and attached from the upper part of the main part of the printer. It is desirable that the above-mentioned handle 135,335,435 is the projection which engages with the inside of the open/close cover 50,150,250, 350 which is the top cover of the main part of the printer.

Moreover, the toner bottle 132,332,432 of the present embodiment has the cap portion 134,334,434 as the rotation unit which can rotate relative to the main part of the container. The outlet D which discharges the developer inside the container, and the shutter 136,336,436 which open and close the outlet D.

The handle 135,335,435 as the first rotation prevention unit which prevents that the cap portion rotates in the first direction when the main part of the printer is equipped with the toner bottle, when the main part of the printer is equipped with the toner bottle and the cap portion rotates in the second direction contrary to the first direction, after opening the shutter 136,336,436 wide.

The engagement wall 138 as the second rotation prevention unit with which the cap portion prevents rotating further in the second direction is established.

While preventing the incorrect setting of the toner bottle, when the shutter is caused to open the outlet, it is possible to prevent the problem produced when the cap portion is rotated excessively.

In addition, in the above-mentioned embodiments, although, as an example of the developer container accommodating the developer, the toner bottle accommodating the toner has been described, the present invention is also applicable to other developers contained in the developer container. That is, they are the two component developer containing the toner and the magnetic carrier, the liquid-development agent containing the toner and the liquid carrier, the magnetic carrier, the liquid carrier, etc.

Moreover, in the above-mentioned embodiments, although the image forming apparatus using the electrophotographic printing method has been explained, the present invention is also applicable to another image forming apparatus which forms the image using other image forming method, such as a direct recording method.

The direct recording method is not based on the latent image support but it utilizes the discharging of the toner in the shape of a dot by the print head by which the toner adheres to the recording medium or the middle recording medium directly, and forms the image of picture elements.

Further, the present invention is not limited to the above-described embodiments, and variations and modifications may be made without departing from the scope of the present invention.

What is claimed is:

1. A developer supplying device which includes a developer container having a main part configured to accommodate a developer therein and having an opening at an end surface of the container main part, and a rotation unit attached to the container main part to cover the opening and having an outlet provided on a circumferential surface of the rotation unit and communicating with the opening, wherein the developer in the container main part is moved to the opening and discharged from the outlet when the container main part, attached to a container mounting unit, is rotated around a longitudinal axis of the container main part, so that the developer supplying device supplies the developer discharged from the developer container to a developer receiving device, wherein the developer container comprises a shutter provided on the rotation unit to open and close the outlet by a movement of the shutter relative to the rotation unit in a rotation direction of the container main part, the developer supplying device is provided to apply a frictional force to cause the relative movement of the shutter and the rotation unit in a direction to close the outlet during the rotation of the container main part, and the developer supplying device comprises a regulation unit regulating the relative movement of the shutter and the rotation unit in the direction to close the outlet, by using the frictional force with the container main part when the container main part is rotated to discharge the developer from the outlet.

2. The developer supplying device according to claim 1, wherein the developer container is provided to apply the frictional force to the rotation unit so as to cause the relative movement of the shutter and the rotation unit in the direction to close the outlet when the container main part is rotated, and the developer supplying device comprises a rotation prevention unit preventing rotation of the shutter relative to the rotation unit in the rotating direction of the container main part when the developer container is attached to the container mounting unit, and when the rotation unit is rotated in the rotating direction of the container main part, the relative movement of the shutter and the rotation unit is allowed in the direction to close the outlet so that the outlet is closed by the shutter.

3. The developer supplying device according to claim 1, wherein the developer container is provided to apply the frictional force to the shutter so as to cause the relative movement of the shutter and the rotation unit in the direction to close the outlet when the container main part is rotated, and the developer supplying device comprises a rotation prevention unit preventing rotation of the rotation unit relative to the shutter in the rotating direction of the container main part when the developer container is attached to the container mounting unit, and when the shutter is rotated in the rotating direction of the container main part, the relative movement of the rotation unit and the shutter is allowed in the direction to close the outlet so that the outlet is closed by the shutter.

4. The developer supplying device according to claim 1, wherein the developer supplying device is provided to allow the relative movement of the shutter and the rotation unit according to a displacement of a displacement member, and the regulation unit comprises a displacement regulation unit regulating displacement of the displacement member from a position corresponding to a relative position of the rotation unit and the shutter to open the outlet in a direction to cause the relative movement of the rotation unit and the shutter to close the outlet.

5. The developer supplying device according to claim 1, further comprising:

the developer.

6. The developer supplying device according to claim 1, wherein the developer is toner.

7. An image forming apparatus, comprising:

a visible image formation unit forming a visible image on an image supporting medium; and a developer supplying device which includes a developer container having a main part accommodating a developer therein and having an opening at an end surface of the container main part, and a rotation unit attached to the container main part to cover the opening and having an outlet provided on a circumferential surface of the rotation unit and communicating with the opening, wherein the developer in the container main part is moved to the opening and discharged from the outlet when the container main part, attached to a container mounting unit, is rotated around a longitudinal axis of the container main part, so that the developer supplying device supplies the developer discharged from the developer container to a developer receiving device of the visible image formation unit, wherein the developer container comprises a shutter provided on the rotation unit to open and close the outlet by a movement of the shutter relative to the rotation unit in a rotation direction of the container main part, the developer supplying device is provided to apply a frictional force to cause the relative movement of the shutter and the rotation unit in a direction to close the outlet during the rotation of the container main part, and the developer supplying device comprises a regulation unit regulating the relative movement of the shutter and the rotation unit in the direction to close the outlet, by using the frictional force with the container main part when the container main part is rotated to discharge the developer from the outlet.

8. The image forming apparatus according to claim 7, wherein the developer supplying device is provided to allow the relative movement of the shutter and the rotation unit according to a displacement of a displacement member, and the regulation unit comprises a displacement regulation unit regulating displacement of the displacement member from a position corresponding to a relative position of the rotation unit and the shutter to open the outlet in a direction to cause the relative movement of the rotation unit and the shutter to close the outlet, and wherein the visible image formation unit and the developer supplying device are arranged in a housing, and the housing is provided with an insertion opening and an open/close cover, the developer container is detachably attached to the container mounting unit of the developer supplying device through the insertion opening, and the open/close cover is provided to open or close the insertion opening.

9. The image forming apparatus according to claim 8, wherein the image forming apparatus is provided so that the displacement member is positioned to project toward the insertion opening when the displacement member is located at the insertion opening, and the displacement regulation unit is provided so that the displacement member at the insertion opening is fitted into a recess on an inside surface of the open/close cover by closing the open/close cover.

10. The image forming apparatus according to claim 8, wherein the image forming apparatus comprises a guiding unit guiding the displacement member to the opened position through contact of the inside surface of the open/close cover and the displacement member not located at the opening when the open/close cover is placed in the closed position on the housing.

11. The developer supplying device according to claim 7, wherein the developer is toner.

12. A cylindrical developer container which has a main part accommodating a developer therein and is detachably attached to an image forming apparatus, comprising:

a rotation unit which is rotatable relative to the container main part;

an outlet provided on the rotation unit to discharge the developer in the developer container;

a shutter provided on the rotation unit to open and close the outlet by rotation of the rotation unit when the container is attached to the image forming apparatus; and an engagement unit provided on a peripheral side portion of the rotation unit, the engagement unit being engaged with the image forming apparatus to prevent rotation of the rotation unit.

13. The developer container according to claim 12, wherein the developer container is detachably attached from an upper part of the image forming apparatus, and the engagement unit is configured to contact a projection connected to an inside surface of a cover of the image forming apparatus.

14. The developer supplying device according to claim 12, wherein the developer is toner.

15. A cylindrical developer container which has a main part accommodating a developer therein and is detachably attached to an image forming apparatus, comprising:

a rotation unit which is rotatable relative to the container main part;

an outlet provided on the rotation unit to discharge the developer from the container;

a shutter provided on the rotation unit to open and close the outlet by rotation of the rotation unit;

a first rotation preventing unit provided on the rotation unit to prevent the rotation unit from being rotated in a first direction when the container is attached to the image forming apparatus; and a second rotation preventing unit provided on the rotation unit to prevent the rotation unit from being rotated further in a second direction opposite to the first direction after the rotation unit is rotated in the second direction by the attachment of the container to the image forming apparatus and the shutter is caused to open the outlet by the rotation of the rotation unit.

16. The developer supplying device according to claim 15, wherein the developer is toner.

17. A cylindrical developer container which has a container main part for accommodating a developer therein and is to be detachably attached to an image forming apparatus, comprising:

a rotation unit which is rotatable relative to the container main part;

an outlet provided on the rotation unit to discharge the developer from the developer container;

a shutter provided on the rotation unit to cover and expose the outlet depending on a rotational position of the rotation unit when the container is attached to the image forming apparatus; and engaging means, provided on a circumferential surface of the rotation unit, for engaging with the image forming apparatus to prevent rotation of the rotation unit.

18. The developer container according to claim 17, wherein the developer container is detachably attached from an upper side of the image forming apparatus, and the engaging means is a projection that fits into a portion formed at an inside surface of a cover of the image forming apparatus.

19. The developer supplying device according to claim 17, wherein the developer is toner.

20. A cylindrical developer container which has a container main part for accommodating a developer therein and is to be detachably attached to an image forming apparatus, comprising:

a rotation unit which is rotatable relative to the container main part;

an outlet provided on the rotation unit to discharge the developer from the developer container;

a shutter provided on the rotation unit to cover and expose the outlet;

first rotation preventing means, provided on the rotation unit, for preventing the rotation unit from being rotated in a first direction after the development container is attached to the image forming apparatus; and second rotation preventing means, provided on the rotation unit, for preventing the rotation unit from being rotated further in a second direction opposite the first direction after the rotation unit is rotated in the second direction to open the shutter in association with movement of attaching the development container to the image forming apparatus.

21. The developer supplying device according to claim 20, wherein the developer is toner.

22. A cylindrical developer container which has a container main part for accommodating a developer therein and is to be detachably attached to an image forming apparatus, comprising:

a rotation unit which is rotatable relative to the container main part;

an outlet provided on the rotation unit to discharge the developer from the developer container;

a shutter provided on the rotation unit to cover and expose the outlet depending on a rotational position of the rotation unit when the container is attached to the image forming apparatus; and a projection which is provided on a circumferential surface of the rotation unit, and engages with the image forming apparatus to prevent rotation of the rotation unit.

23. The developer supplying device according to claim 22, wherein the developer is toner.

24. A cylindrical developer container which has a container main part for accommodating a developer therein and is to be detachably attached to an image forming apparatus, comprising:

a rotation unit which is rotatable relative to the container main part;

an outlet provided on the rotation unit to discharge the developer from the developer container;

a shutter provided on the rotation unit to cover and expose the outlet;

a projection which is provided on the rotation unit to engage with the image forming apparatus, and prevents the rotation unit from being rotated in a first direction after the development container is attached to the image forming apparatus; and a stopper wall which is provided on the rotation unit to engage with the image forming apparatus, and prevents the rotation unit from being rotated further in a second direction opposite the first direction after the rotation unit is rotated in the second direction to open the shutter in association with movement of attaching the development container to the image forming apparatus.

25. The developer supplying device according to claim 24, wherein the developer is toner.

* * * * *